US009113773B2

(12) United States Patent
Bartloff et al.

(10) Patent No.: US 9,113,773 B2
(45) Date of Patent: Aug. 25, 2015

(54) DISHWASHER RACK ASSEMBLY WITH TRIM ASSEMBLY

(71) Applicant: Whirlpool Corporation, Benton Harbor, MI (US)

(72) Inventors: William F. Bartloff, Berrien Springs, MI (US); Rexford W. Cordill, Granger, IN (US); Joseph T. Ferencevich, Saint Joseph, MI (US); Richard L. Hammond, Grand Haven, MI (US); Matthew J. Herman, Columbus Grove, OH (US); Susan K. Schuman-Kerr, Berrien Springs, MI (US); Michael S. Seeley, South Haven, MI (US); Jeffrey R. Taylor, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/104,201

(22) Filed: Dec. 12, 2013

(65) Prior Publication Data

US 2015/0164301 A1 Jun. 18, 2015

(51) Int. Cl.

| | |
|---|---|
| ***A47G 19/08*** | (2006.01) |
| ***A47F 5/00*** | (2006.01) |
| ***A47L 15/50*** | (2006.01) |
| ***A47B 55/02*** | (2006.01) |
| ***A47B 95/04*** | (2006.01) |
| ***A47F 5/01*** | (2006.01) |
| ***A47L 19/04*** | (2006.01) |

(52) U.S. Cl.

CPC ..... *A47L 15/50* (2013.01); *A47B 55/02* (2013.01); *A47B 95/043* (2013.01); *A47F 5/01* (2013.01); *A47L 19/04* (2013.01); *A47B 2095/046* (2013.01)

(58) Field of Classification Search

CPC ..... A47L 15/50; A47L 15/501; A47L 15/503; A47L 15/504; A47L 15/506; A47L 15/507; A47L 19/04; A47B 77/02; A47B 13/083; A47B 13/08; A47B 95/043; A47B 2095/046; A47B 95/04; A47B 55/02; A47B 13/085; A47B 73/002; A47B 81/04; A47F 5/01; A47F 5/13; A47F 5/14; A47F 5/0031

USPC ..... 211/90.03, 90.01, 183, 153, 41.8, 41.9, 211/106, 181.1, 175, 90.02; 108/27; 312/348.3; 220/572, 487, 488; D32/8, D32/55–59

See application file for complete search history.

(56) References Cited

U.S. PATENT DOCUMENTS

| | | | | |
|---|---|---|---|---|
| 2,309,212 | A * | 1/1943 | Reeves | 211/153 |
| 3,174,627 | A * | 3/1965 | Marschak | 248/220.41 |
| 4,898,285 | A * | 2/1990 | Field | 211/183 |
| 5,050,583 | A * | 9/1991 | Chapek et al. | 126/500 |

(Continued)

FOREIGN PATENT DOCUMENTS

| | | | |
|---|---|---|---|
| EP | 0648463 | A1 | 4/1995 |
| EP | 0739176 | A1 | 10/1996 |

(Continued)

*Primary Examiner* — Jennifer E Novosad

(57) ABSTRACT

A rack assembly for supporting dishes in a dishwasher may comprise a wire frame rack having a plurality of wire elements and a trim assembly having at least one trim element and at least one tolerance adjuster mounted to the wire frame rack. The at least one trim element and the at least one tolerance adjuster may cooperate to alter the effective length of the trim assembly.

20 Claims, 27 Drawing Sheets

(56) References Cited

U.S. PATENT DOCUMENTS

| | | | | |
|---|---|---|---|---|
| 5,133,463 | A * | 7/1992 | Merl | 211/190 |
| 5,199,415 | A * | 4/1993 | Johnson, Jr. | 126/500 |
| D353,921 | S | 12/1994 | Lippisch et al. | |
| 5,415,302 | A * | 5/1995 | Carlson et al. | 211/187 |
| 5,697,305 | A * | 12/1997 | Chasan et al. | 108/90 |
| 5,730,301 | A | 3/1998 | Welch et al. | |
| D399,614 | S | 10/1998 | Goodin et al. | |
| D403,472 | S | 12/1998 | Goodin et al. | |
| D412,607 | S | 8/1999 | Goodin et al. | |
| 6,408,768 | B1 * | 6/2002 | Giampavolo et al. | 108/27 |
| 6,622,740 | B1 | 9/2003 | Durazzani | |
| 6,786,339 | B2 | 9/2004 | Deiss et al. | |
| 7,066,563 | B2 * | 6/2006 | Berger | 312/348.3 |
| D534,701 | S | 1/2007 | Schmidt | |
| 7,182,210 | B2 * | 2/2007 | Metcalf | 211/175 |
| D539,004 | S * | 3/2007 | Giampavolo | D34/38 |
| 7,594,513 | B2 | 9/2009 | VanderReost et al. | |
| 7,810,440 | B2 * | 10/2010 | Ward | 108/90 |
| D644,804 | S | 9/2011 | Baldwin | |
| D645,219 | S | 9/2011 | Baldwin | |
| 8,424,467 | B2 * | 4/2013 | Giampavolo et al. | 108/51.11 |
| 8,430,253 | B1 * | 4/2013 | Jackson et al. | 211/90.03 |
| 8,567,882 | B1 * | 10/2013 | Garnett | 312/228.1 |
| 8,701,898 | B2 * | 4/2014 | Chai | 211/41.6 |
| 8,783,476 | B2 * | 7/2014 | Woodley et al. | 211/183 |
| 8,789,475 | B1 * | 7/2014 | Giampavolo et al. | 108/27 |
| 2001/0014250 | A1 * | 8/2001 | Plummer et al. | 403/295 |
| 2004/0245200 | A1 * | 12/2004 | Jersey et al. | 211/189 |
| 2006/0054063 | A1 * | 3/2006 | Ryan | 108/27 |
| 2007/0023374 | A1 * | 2/2007 | Nawrocki | 211/90.01 |
| 2007/0251426 | A1 * | 11/2007 | Li | 108/27 |
| 2009/0211994 | A1 | 8/2009 | Yang et al. | |
| 2012/0291824 | A1 | 11/2012 | Bhajak et al. | |
| 2014/0263131 | A1 * | 9/2014 | Hansel et al. | 211/183 |

FOREIGN PATENT DOCUMENTS

| | | | |
|---|---|---|---|
| EP | 1306046 | A1 | 5/2003 |
| EP | 1985223 | A1 | 10/2008 |
| EP | 1985224 | A1 | 10/2008 |
| EP | 2181638 | A1 | 5/2010 |
| EP | 2371260 | A1 | 10/2011 |
| FR | 2019259 | A7 | 6/1970 |
| FR | 2958145 | A1 | 10/2011 |
| GB | 2359248 | A | 8/2001 |
| GB | 2380662 | A | 4/2003 |
| JP | 2009219530 | A | 10/2009 |
| KR | 101154957 | A | 8/2006 |
| KR | 20120107225 | A | 10/2012 |
| KR | 101290357 | | 7/2013 |

* cited by examiner

DISHWASHER RACK ASSEMBLY WITH TRIM ASSEMBLY

BACKGROUND

Most domestic dishwashers include at least one dish rack to support dishes to be washed, such as dishware, glassware, kitchen utensils, silverware, pots and pans, and the like. The dish rack is typically formed from several wire elements welded together and then covered with a rubber or plastic coating. In some cases, the dish rack also includes a plurality of tines oriented to support and organize the dishes placed on the dish rack.

SUMMARY

A rack assembly according to one embodiment for supporting dishes in a dishwasher may comprise a wire frame rack having a plurality of wire elements forming a peripheral wall having an upper end, with at least a portion of the upper end having a first length, and a trim assembly having at least one trim element and at least one tolerance adjuster mounted to at least a portion of the peripheral wall upper end, with the at least one trim element and the at least one tolerance adjuster cooperating to alter the effective length of the trim assembly to correspond with the first length and thereby compensate for variation in the first length.

DESCRIPTION OF EMBODIMENTS OF THE INVENTION

Figure 1:
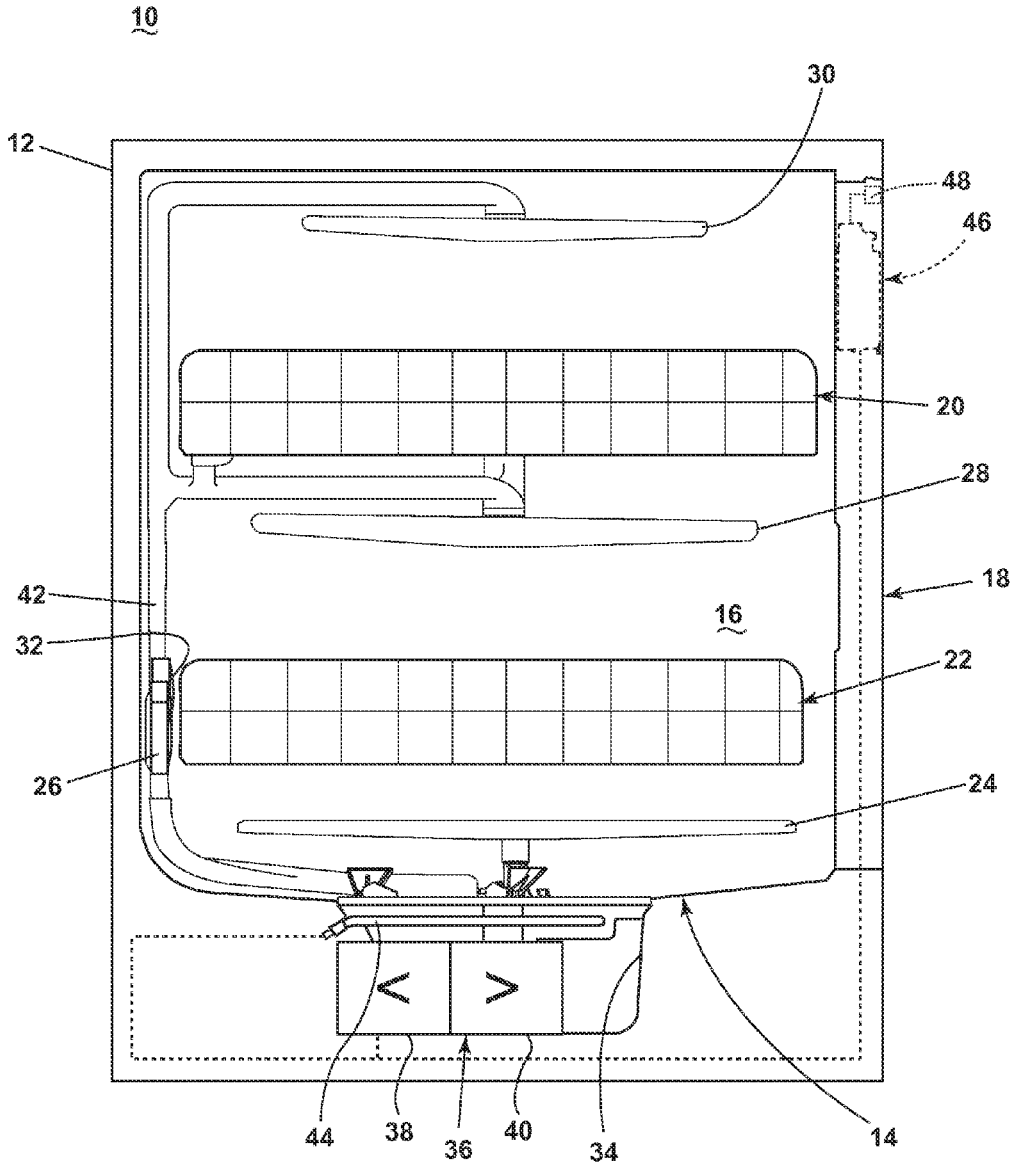
FIG. 1 is a schematic side cross-sectional view of a dishwasher according to a one embodiment.

FIG. 1 schematically illustrates an exemplary automated dishwasher 10 according to a first embodiment. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish rack assemblies 20, 22, are located within the treating chamber 16 and receive dishes for treatment, such as washing. The upper and lower rack assemblies 20, 22 are typically mounted for slidable movement in and out of the treating chamber 16 for ease of loading and unloading. Other dish holders may be provided, such as a silverware basket, separate from or combined with the upper and lower rack assemblies 20, 22. As used in this description, the term "dish(es)" is intended to be generic to any item, single or plural, that may be treated in the dishwasher 10, including, without limitation, dishes, plates, pots, bowls, pans, glassware, and silverware.

A spray system may be provided for spraying liquid in the treating chamber 16 and may be provided in the form of, for example, a first lower spray assembly 24, a second lower spray assembly 26, a mid-level spray assembly 28, and/or an upper spray assembly 30. The upper spray assembly 30, the mid-level spray assembly 28, and the lower spray assembly 24 are located, respectively, above the upper rack assembly 20, beneath the upper rack assembly 20, and beneath the lower rack assembly 22 and are illustrated as rotating spray arms by example but are not limited to such positions and sprayer type. The second lower spray assembly 26 is illustrated as being located adjacent the lower dish rack assembly 22 toward the rear of the treating chamber 16. The second lower spray assembly 26 is illustrated by example as including a vertically oriented distribution header or spray manifold 32. An exemplary spray manifold is set forth in detail in U.S. Pat. No. 7,594,513, issued Sep. 29, 2009, and titled "Multiple Wash Zone Dishwasher," which is incorporated herein by reference in its entirety.

A recirculation system may be provided for recirculating liquid from the treating chamber 16 to the spray system. The recirculation system may include a sump 34 and a pump assembly 36. The sump 34 collects the liquid sprayed in the treating chamber 16 and may be formed by a sloped or recess portion of a bottom wall of the tub 14. The pump assembly 36 may include both a drain pump 38 and a recirculation pump 40. The drain pump 38 may draw liquid from the sump 34 and pump the liquid out of the dishwasher 10 to a household drain line (not shown). The recirculation pump 40 may draw liquid from the sump 34, and the liquid may be simultaneously or selectively pumped through a supply tube 42 to each of the spray assemblies 24, 26, 28, 30 for selective spraying. While not shown, a liquid supply system may include a water supply conduit coupled with a household water supply for supplying water to the treating chamber 16.

A heating system including a heater 44 may be located, for example, within the sump 34 for heating the liquid contained in the sump 34.

A controller 46 may also be included in the dishwasher 10, which may be operably coupled with various components of the dishwasher 10 to implement a cycle of operation. The controller 46 may be located within the door assembly 18 as illustrated, or it may alternatively be located somewhere within the chassis 12. The controller 46 may also be operably coupled with a control panel or user interface 48 for receiving user-selected inputs and communicating information to the user. The user interface 48 may include operational controls such as dials, lights, switches, and displays enabling a user to input commands, such as a cycle of operation, to the controller 46 and receive information.

Figure 2:
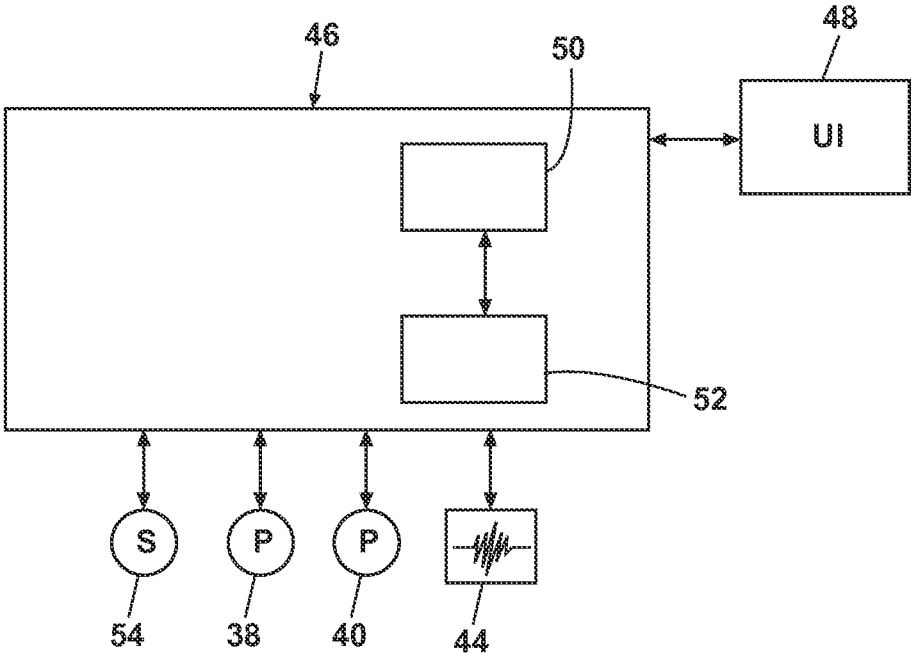
FIG. 2 is a schematic view of a controller of the dishwasher of FIG. 1.

As illustrated schematically in FIG. 2, the controller 46 may be coupled with the heater 44 for heating the wash liquid during a cycle of operation, the drain pump 38 for draining liquid from the treating chamber 16, and the recirculation pump 40 for recirculating the wash liquid during the cycle of operation. The controller 46 may be provided with a memory 50 and a central processing unit (CPU) 52. The memory 50 may be used for storing control software that may be executed by the CPU 52 in completing a cycle of operation using the dishwasher 10 and any additional software. For example, the memory 50 may store one or more pre-programmed cycles of operation that may be selected by a user and completed by the dishwasher 10. The controller 46 may also receive input from one or more sensors 54. Non-limiting examples of sensors that may be communicably coupled with the controller 46 include a temperature sensor and turbidity sensor to determine the soil load associated with a selected grouping of dishes, such as the dishes associated with a particular area of the treating chamber 16.

Figure 3:
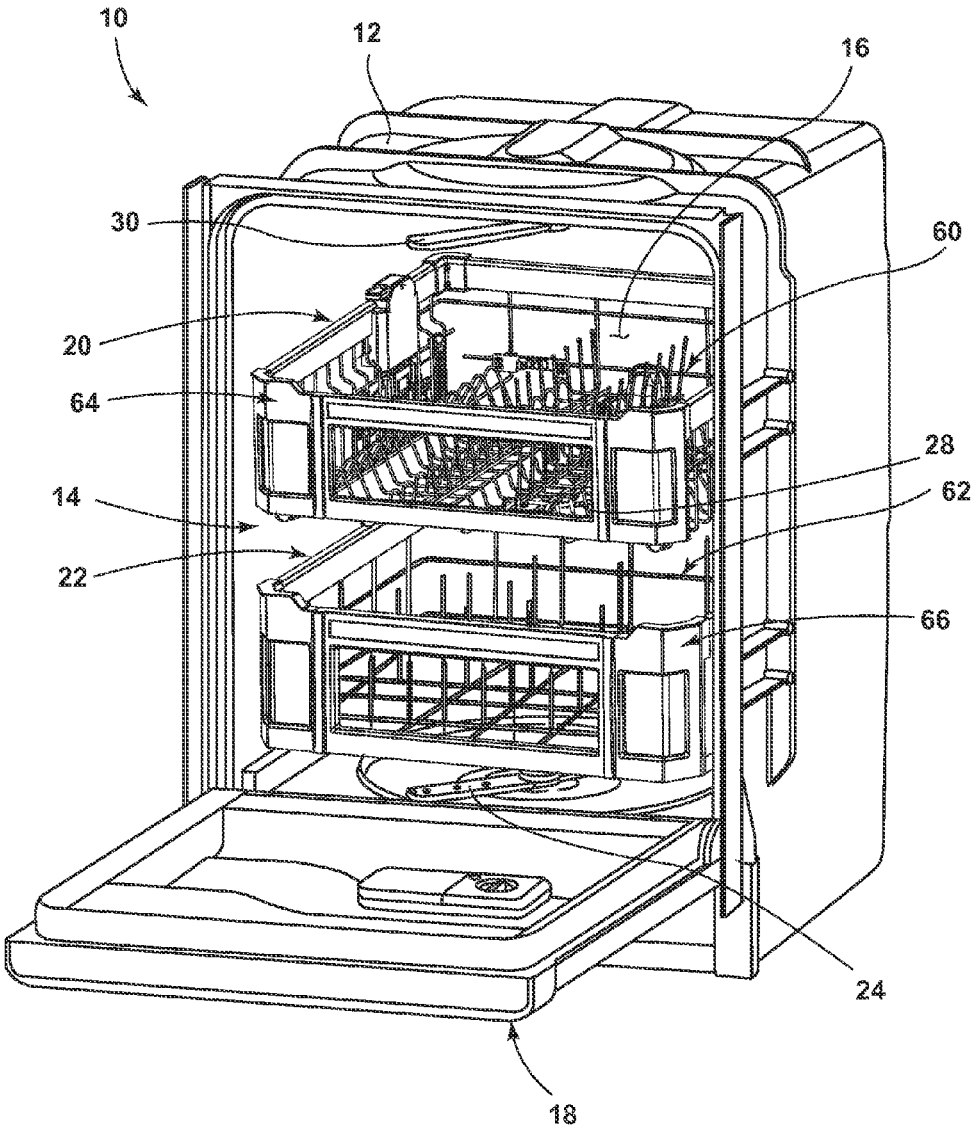
FIG. 3 is a perspective view of the dishwasher of FIG. 1 showing upper and lower dish rack assemblies according to one embodiment.
Figure 4A:
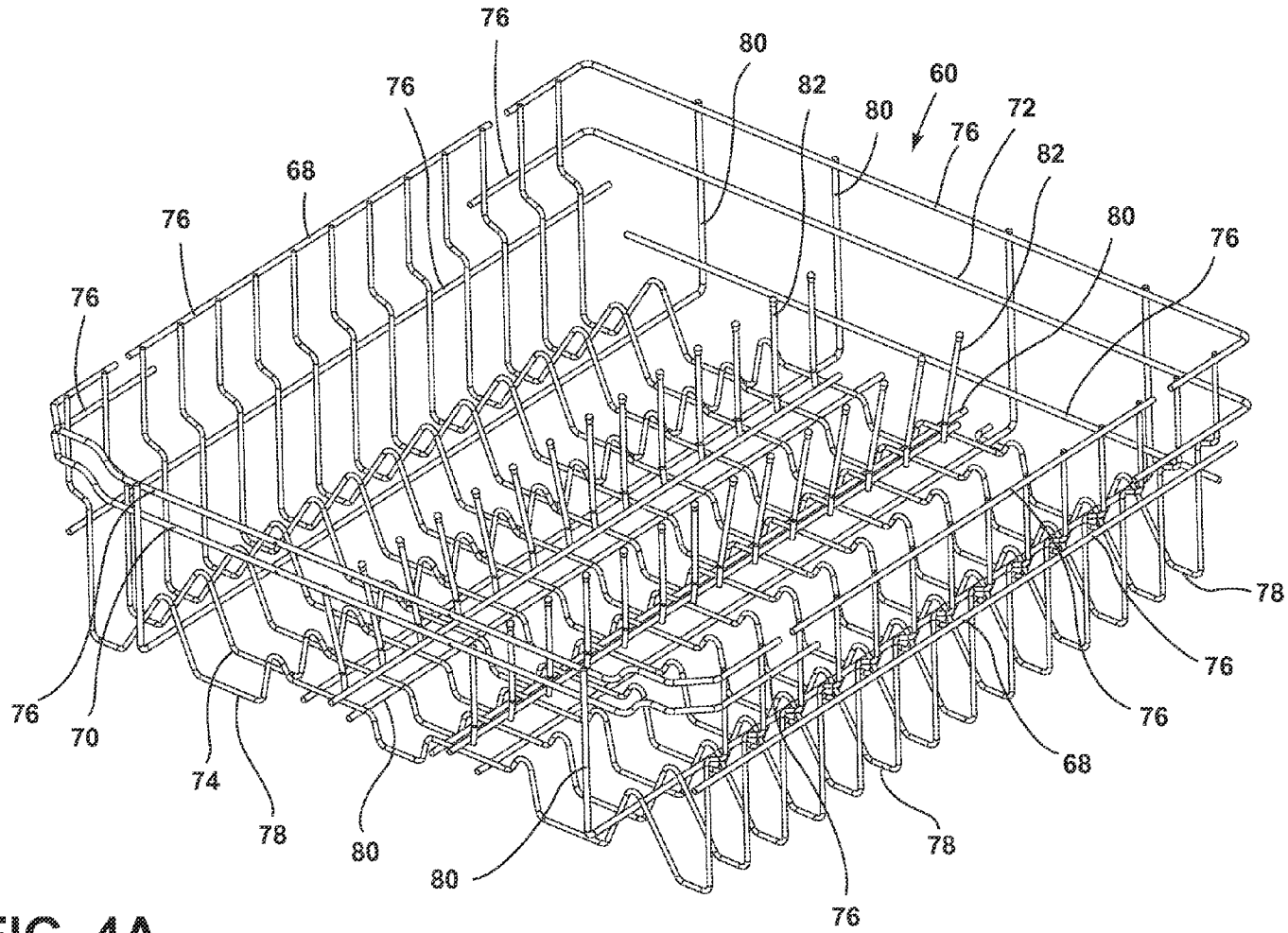
FIG. 4A is a perspective view of a wire frame rack of the upper dish rack assembly of FIG. 3.

FIG. 3 provides a perspective view of the dishwasher 10 showing the exemplary upper and lower rack assemblies 20, 22. The upper and lower rack assemblies 20, 22 may each include a wire frame rack 60, 62 and a corresponding trim assembly 64, 66. The wire frame rack 60 for the upper rack assembly 20 may be viewed in detail in the perspective view in FIG. 4A. The exemplary wire frame rack 60 may have a peripheral wall formed by a pair of opposed side walls 68 joined by a front wall 70 and a rear wall 72 and a bottom wall 74 joining the lower ends of the peripheral wall 68, 70, 72. The peripheral wall 68, 70, 72 and the bottom wall 74 may be constructed by a plurality of wire elements. Peripheral wire elements 76 may extend generally horizontally around at least around a portion of the periphery of the wire frame rack 60, and side-to-side (extending generally in the direction defined between the side walls 68) and front-to-rear (extending generally in the direction between the front and rear walls 70, 72) intersecting wire elements 78, 80 may intersect one another to form the bottom wall 74. Additionally, the intersecting wire elements 78, 80 may turn upward at their ends in a generally vertical direction to, together with the peripheral wire elements 76, form the peripheral wall 68, 70, 72. Optionally, tines 82 may be integrated with or mounted to the upper wire frame rack 60.

Figure 4B:
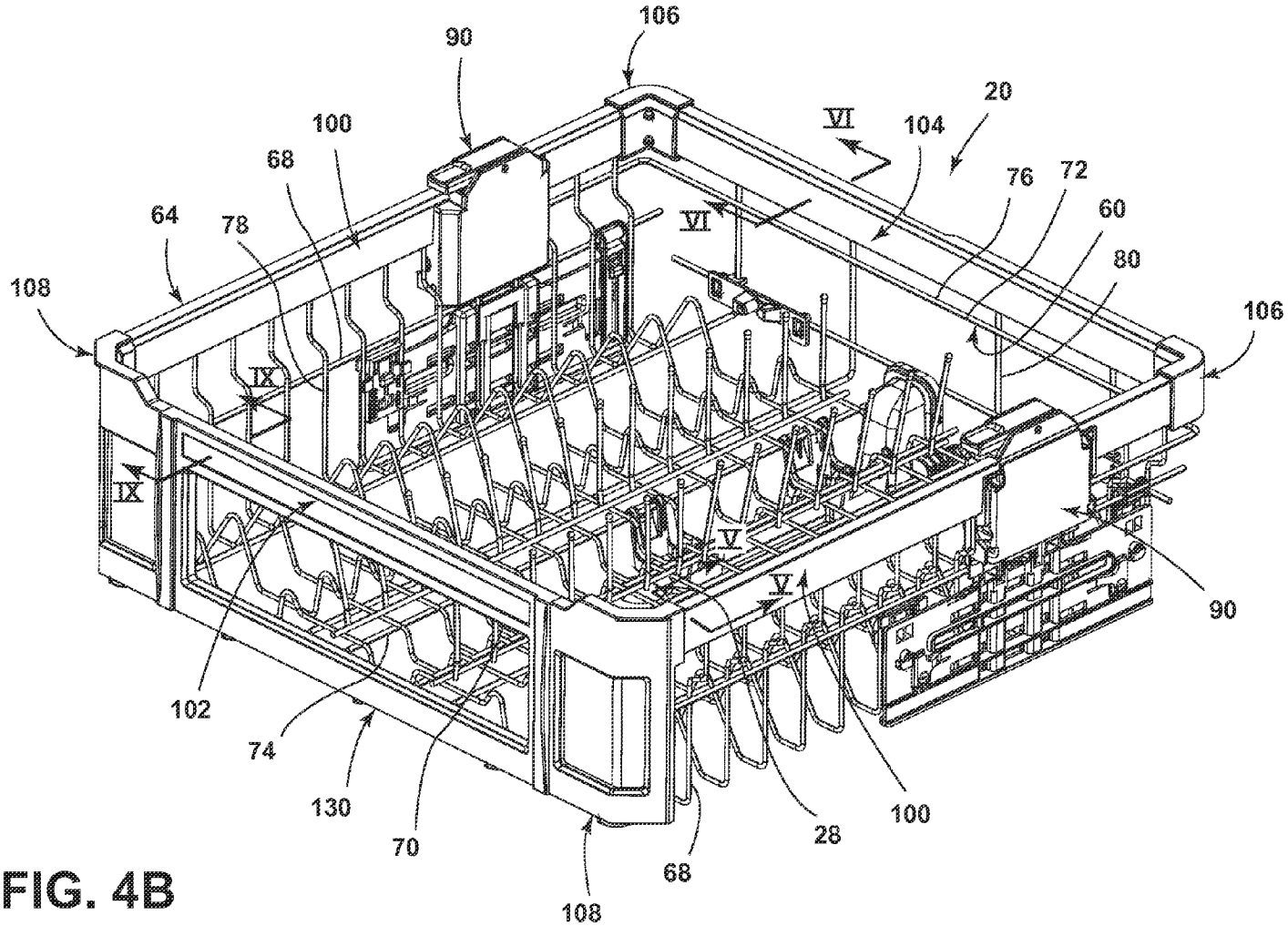
FIG. 4B is a perspective view of the upper dish rack assembly of FIG. 3 having the wire frame rack of FIG. 4A and an upper trim assembly.

Referring now to FIG. 4B, which is a perspective view of the upper rack assembly 20, the upper wire frame rack 60 supports the upper trim assembly 64 along with a rack height adjustment assembly 90 and the mid-level spray assembly 28. The rack height adjustment assembly 90 can be any type of suitable assembly for adjusting the vertical position of the upper rack assembly 20 within the dishwasher 10 and is not limited to that shown in the figures. The wire frame rack 60 can also support additional rack accessories if desired.

The upper trim assembly 64 may be mounted to the upper wire frame rack 60 and may extend around the entire peripheral wall 68, 70, 72 so as to border the wire frame rack 60. Alternatively, the trim assembly 64 may be mounted to only a portion of the periphery of the wire frame rack 60 if desired. The illustrated exemplary embodiment of the trim assembly 64 includes multiple trim elements in the form of rails connected by tolerance adjusters. In particular, the trim assembly includes side rails 100 mounted to an upper end of the side walls 68, a front rail 102 mounted to an upper end of the front wall 70, and a rear rail 104 mounted to an upper end of the rear wall 72. The side rails 100 extend generally the entire length of the side wall 68, with the exception of a section for accommodation of the rack height adjustment assembly 90. The side rails 100 may be formed by two separate sections that are connected to the sides of the rack height adjustment assembly 90, as illustrated. As an alternative, the side rails 100 can be continuous along the side wall 68, such as when the rack assembly 20 employs another type of rack height adjustment assembly 90 or does not include the rack height adjustment assembly 90. Similarly, the front rail 102 and the rear rail 104 can be continuous along the entire length of the front and rear walls 70, 72, respectively. The rails 100, 102, 104 are connected at the corners of the wire frame rack 60 by rear tolerance adjusters 106 at the rear corners and front tolerance adjusters 108 at the front corners. The structure of the rails 100, 102, 104 and the tolerance adjusters 106, 108 will be explained in detail below.

Figure 5:
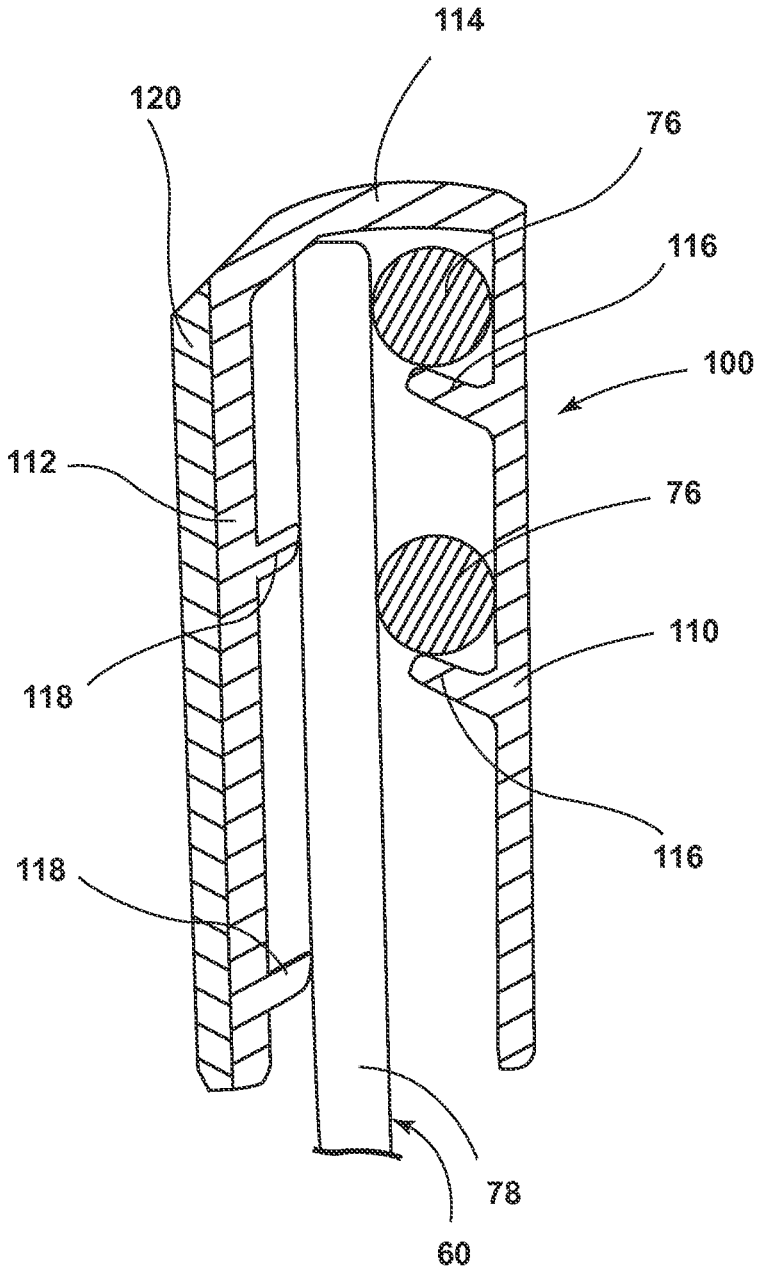
FIG. 5 is a sectional view taken along line V-V of FIG. 4B.

Referring now to FIG. 5, which is a sectional view of the side rail 100 and the wire frame rack 60 taken along line V-V of FIG. 4B, the side rail 100 may have a generally U-shaped configuration with an open bottom. In particular, the side rail 100 may be formed by a generally planar outer wall 110 joined at its upper end to an inner wall 112 by a top wall 114 having an arcuate portion and an angled portion moving from the outer wall 110 to the inner wall 112. As used throughout this description, the terms "outer" and "inner" and similar derivatives generally refer to the relative areas outside of the rack assembly 20 and inside the rack assembly 20, respectively. The side rail 100 may further include one or more projections extending into the interior of the side rail 100 for retaining the side rail 100 on the wire frame rack 60. In the case of the illustrated embodiment, the side rail 100 has two projections extending from each of the outer wall 110 and the inner wall 112. Two upwardly angled projections 116 extending from the outer wall 110 engage the peripheral wire elements 76; the upper of the two projections 116 holds the upper peripheral wire element 76 between the upper of the two projections 116 and the top wall 114, and the lower of the two projections 116 is positioned below the lower peripheral wire element 76, if present. Two upwardly angled projections 118 extending from the inner wall 112 abut the vertical portions of the side-to-side wire elements 78, thus spacing the inner wall 112 from the vertical portions of the side-to-side wire elements 78. The projections 116, 118 retain the side rail 100 on the upper end of the side wall 68 yet allow removal, if desired. The projections 116, 118 may be configured in an alternative manner if desired and may be arranged on opposite walls of the side rail 100 if the peripheral wire elements 76 are alternatively positioned on the inside of the vertical portions of the side-to-side wire elements 78 rather than the outside.

The side rails 100 may optionally comprise multiple materials such that the inner surface of the inner wall 112, i.e., the surface that faces the dishes loaded into the rack assembly 20, is made of a "soft-touch" material to avoid potential breaking, cracking, chipping, or other damage of the dishes. In the illustrated embodiment, the inner wall 112 comprises a layer 120 of a "soft-touch" material coextruded with the rest of the side rail 100 made of a different material. The layer 120 of the "soft-touch" material can have any suitable thickness and can be any suitable material having a desired resiliency or ability to absorb the energy of one or more dishes impacting the side rail 100, such as selected polymers. As an example, a material having a hardness of 55 Shore A, or less, may be a suitable "soft-touch" material. The material comprising the remaining structure of the side rail 100 may be any structurally suitable material, including polymers and metals, and exemplary polymers include, but are not limited to, a polypropylene copolymer (e.g., Pro-Fax 7624) and acrylonitrile butadiene styrene (ABS) (e.g., Lustran 552). Alternatively, the side rail 100 may be constructed such that the entire inner wall 112, rather than only the layer 120, is made of a "soft-touch" material, while the outer wall 110 may be made of a second, different material. Alternatively, the side rail 100 may be constructed of a single material, either the "soft-touch" material or a different material.

Figure 6:
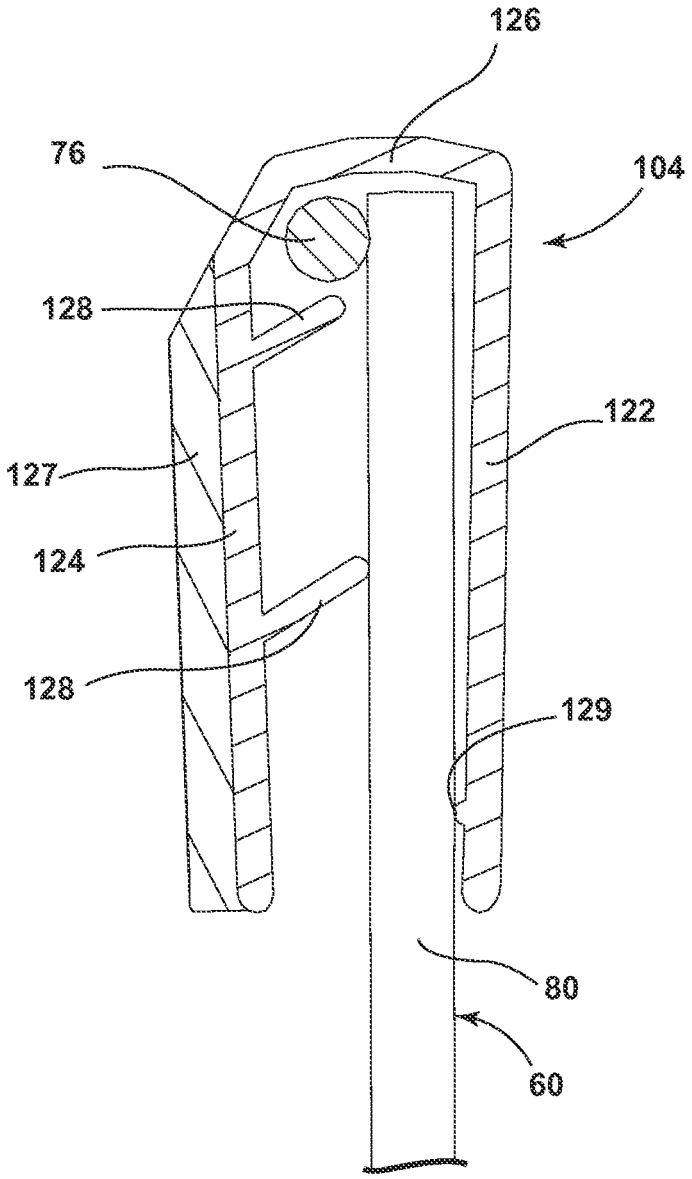
FIG. 6 is a sectional view taken along line VI-VI of FIG. 4B.

The rear rail 104 may be similar to the side rails 100 with respect to the configuration of outer, inner, and top walls 122, 124, 126 and the multiple material construction with a "soft-touch" layer 127, although the rear rail 104 may include only a single material, if desired. An exemplary cross-sectional configuration for the rear rail 104 is illustrated in FIG. 6, which is a sectional view of the rear rail 104 and the wire frame rack 60 taken along line VI-VI of FIG. 4B. In the illustrated embodiment, the peripheral wire element 76 on the rear wall 72 is located on the inside of the vertical portions of the front-to-back wire elements 80, and two upwardly angled projections 128 extend into the interior of the rear rail 104 from the inner wall 124. The upper of the two projections 128 holds the upper peripheral wire element 76 between the upper of the two projections 128 and the top wall 126, and the lower of the two projections 128 is positioned below the lower peripheral wire element 76, if present (not present in the current embodiment). A rib 129 may be located on the inside of the outer wall 122 to space the outer wall 122 from the vertical portion of the front-to-back wire elements 80. Optionally, a section of the outer wall 122 may be removed (FIG. 4B) to accommodate the supply tube 42 (FIG. 1) or other conduit mounted to the rear wall of the tub 14.

Figure 7:
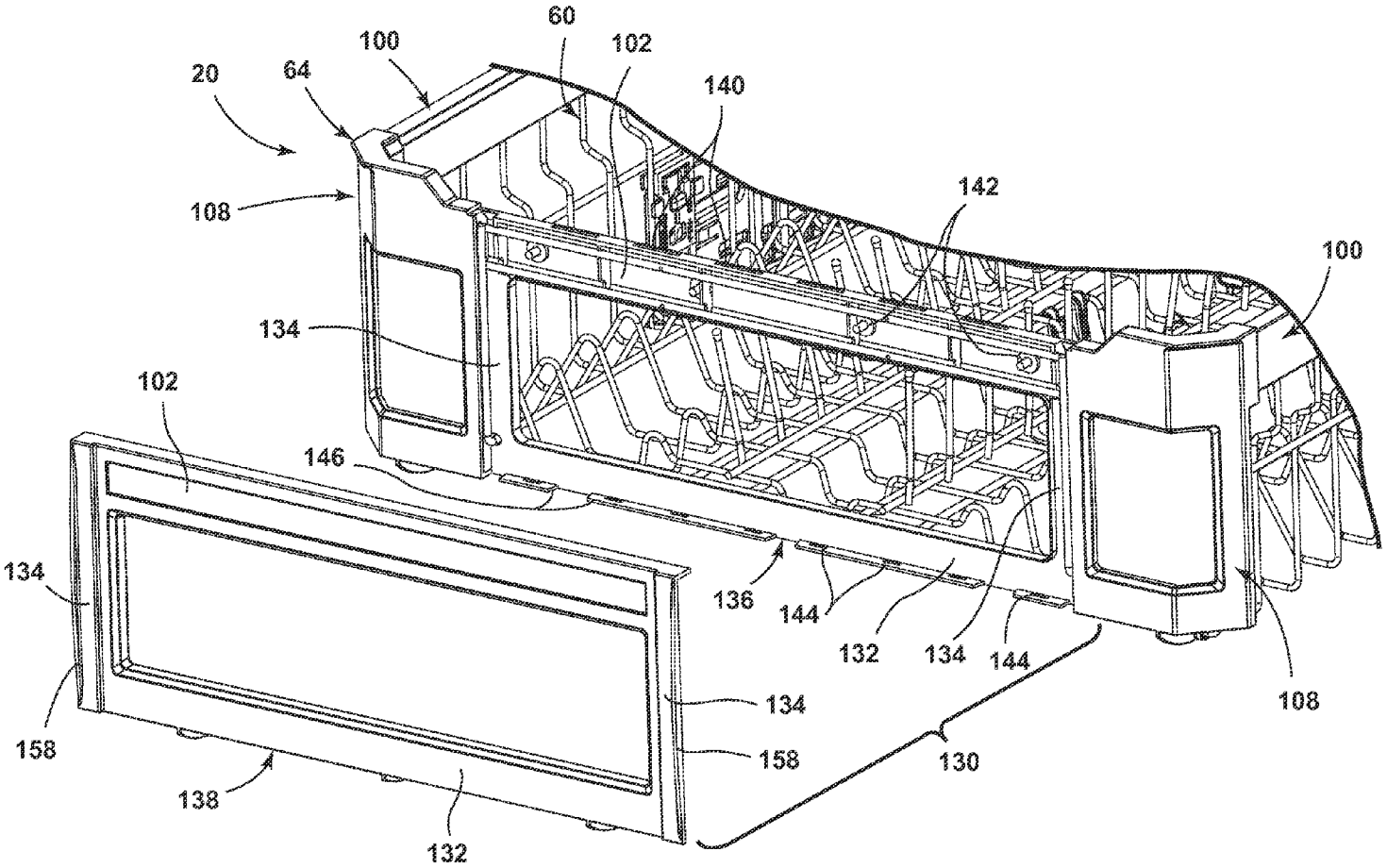
FIG. 7 is partial perspective view of the upper dish rack assembly of FIG. 3 with a front panel of a front frame shown as exploded.
Figure 8:
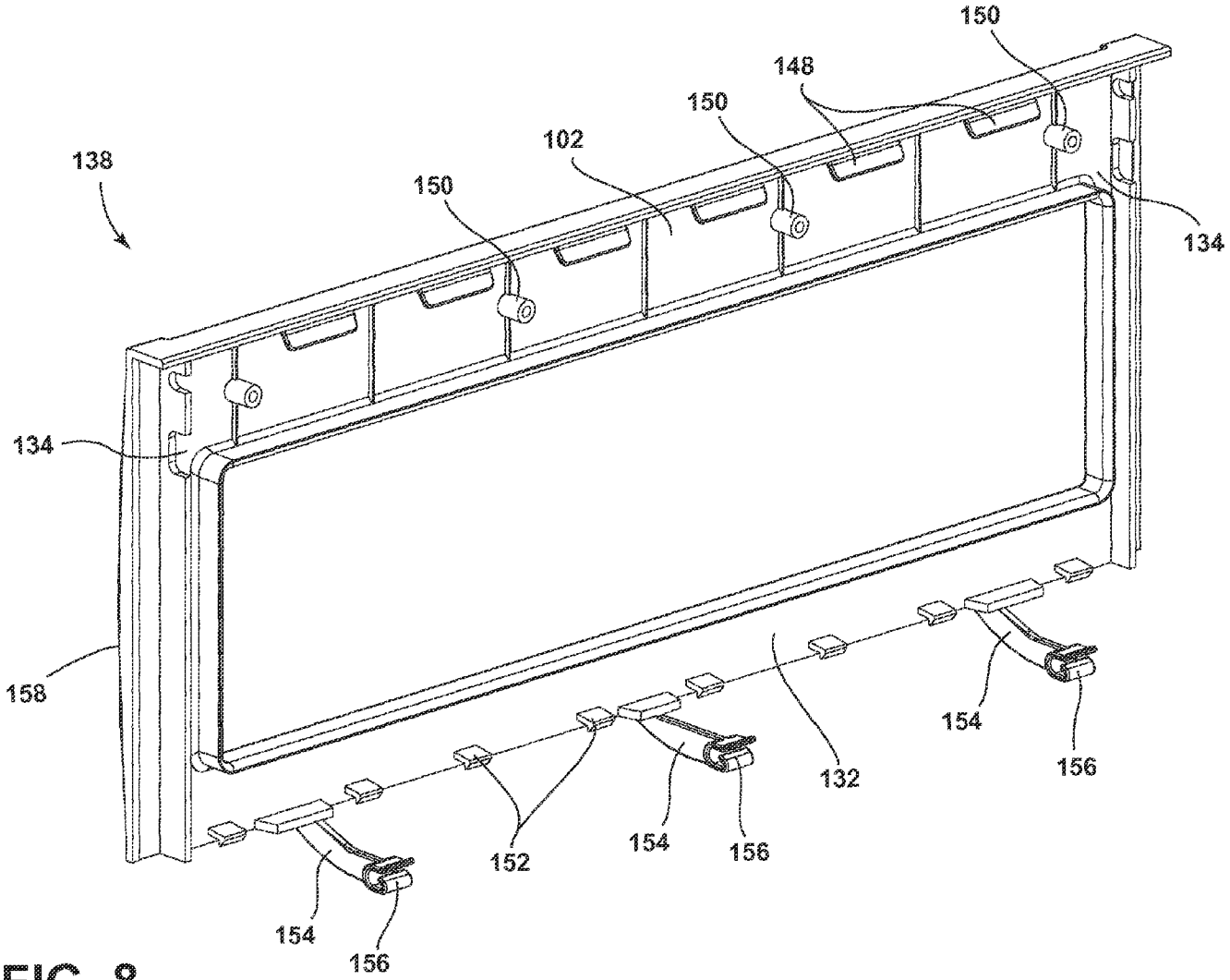
FIG. 8 is a rear perspective view of the front frame of FIG. 7.
Figure 9:
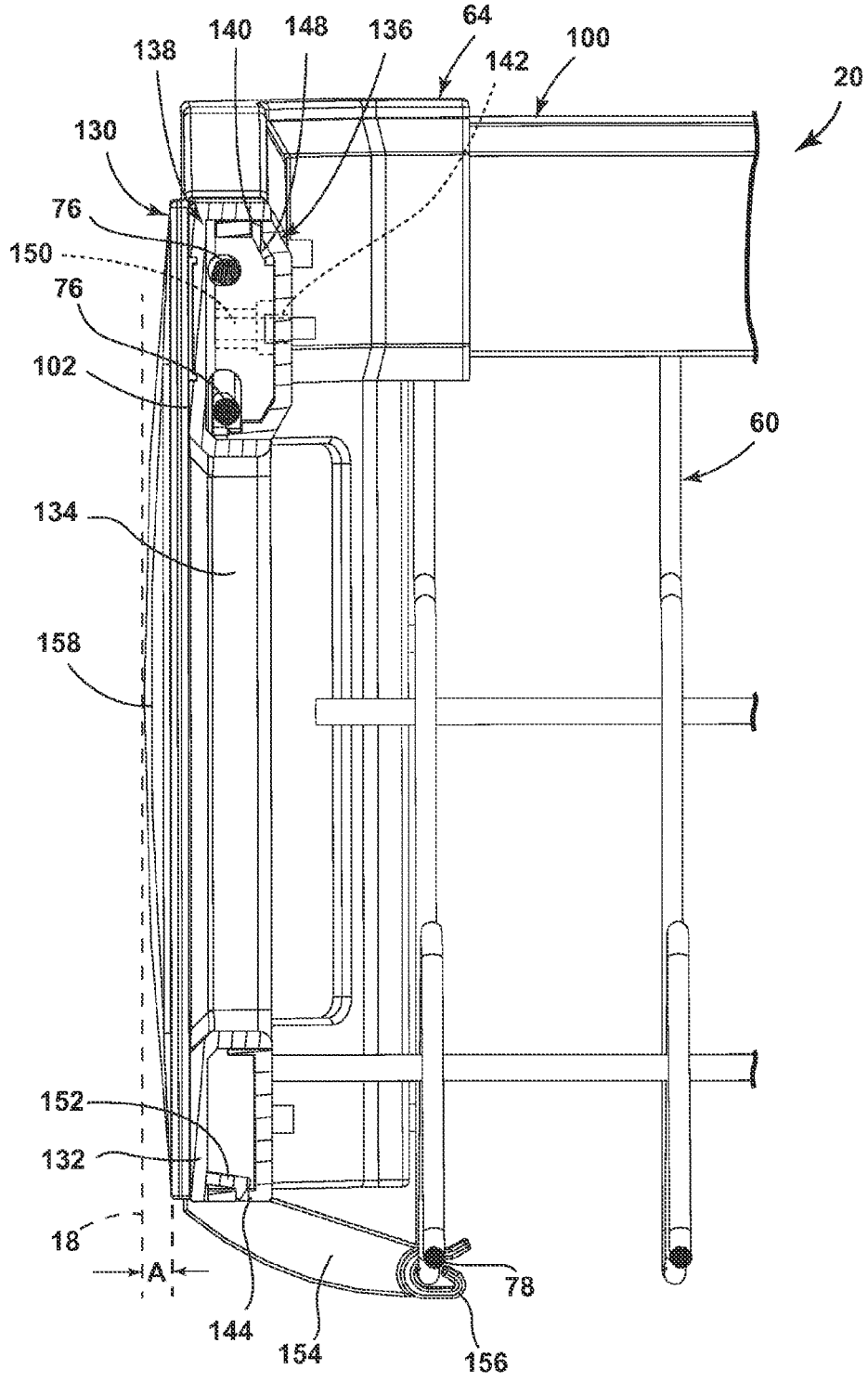
FIG. 9 is a sectional view taken along line IX-IX of FIG. 4B.

Referring now to FIG. 7, the front rail 102 may be part of a front frame 130 mounted to the front wall 70 of the wire frame rack 60. The front frame 130 may include the front rail 102 mounted to one or more, in this case two, peripheral wire elements 76 at the upper end of the front wall 70 and a lower front rail 132 generally parallel to and connected to the upper front rail 102 at their ends by a pair of spaced upright rails 134 mounted to respective vertical portions of front-to-back wire elements 80. The front rail 102 may be configured to mount a decorative piece to provide an aesthetically pleasing appearance to the front of the upper rack assembly. For example, as seen in FIG. 7, the front rail 102 may include a depressed region, such as an elongated, generally rectangular region, sized to receive the decorative piece. The decorative piece may be coupled to the front rail 102 in any suitable manner, such as through a snap-fit connection, adhesive, co-molding, and the like. An inner panel 136 and an outer panel 138 forming the front frame 130 mate with the peripheral wire elements 76 and the front-to-back wire elements 80 therebetween to mount the front frame 130 to the wire frame rack 60. To facilitate the coupling of the inner and outer panels 136, 138, the inner panel 136 includes a plurality of upper slits 140 arranged along an upper edge of the inner panel 136, a plurality of apertures 142 horizontally aligned on the upper front rail 102, and a plurality of lower slits 144 arranged on a plurality of flanges 146 extending forwardly from a lower edge of the inner panel 136. As best seen in FIG. 8, the outer panel 138 includes corresponding tabs 148 arranged along an upper edge of the outer panel 138, a plurality of screw bosses 150 horizontally aligned on the upper front rail 102, and a plurality of resilient tangs 152 extending rearwardly near a lower edge of the outer panel 138. Additionally, a plurality of rearwardly extending arms 154, each terminating at a clip 156, may be disposed along the lower edge of the outer panel 138. As best seen in FIG. 9, which is a sectional view taken along line IX-IX of FIG. 4B, the clips 156 may attach to one of the side-to-side wire elements 78 near the front wall 70 of the wire frame rack 60. FIG. 9 also illustrates the coupling structures joining the inner and outer panels 136, 138, namely the tabs 148 in the upper slits 140, the apertures 142 aligned with the screw bosses 150 for receipt of fasteners, and the tangs 152 in the lower slits 144.

The front frame 130 may include other structural elements, including one or more spacers 158 projecting forward from the upright rails 134 for maintaining a minimum spacing or distance between the remainder of the front frame 130 and the door assembly 18, the inner surface of which is indicated by a dashed line in FIG. 9. As an example, the spacers 158 may maintain a gap A of at least about 0.15 in (3.8 mm) between the front frame 130 and the door assembly 18. Further, the front frame 130 may include various notches, slots, openings, and the like where appropriate to accommodate the peripheral wire elements 76 and the front-to-back wire elements 80, as seen for the inner panel 136 in FIG. 7 and the outer panel 138 in FIG. 8.

Figure 10:
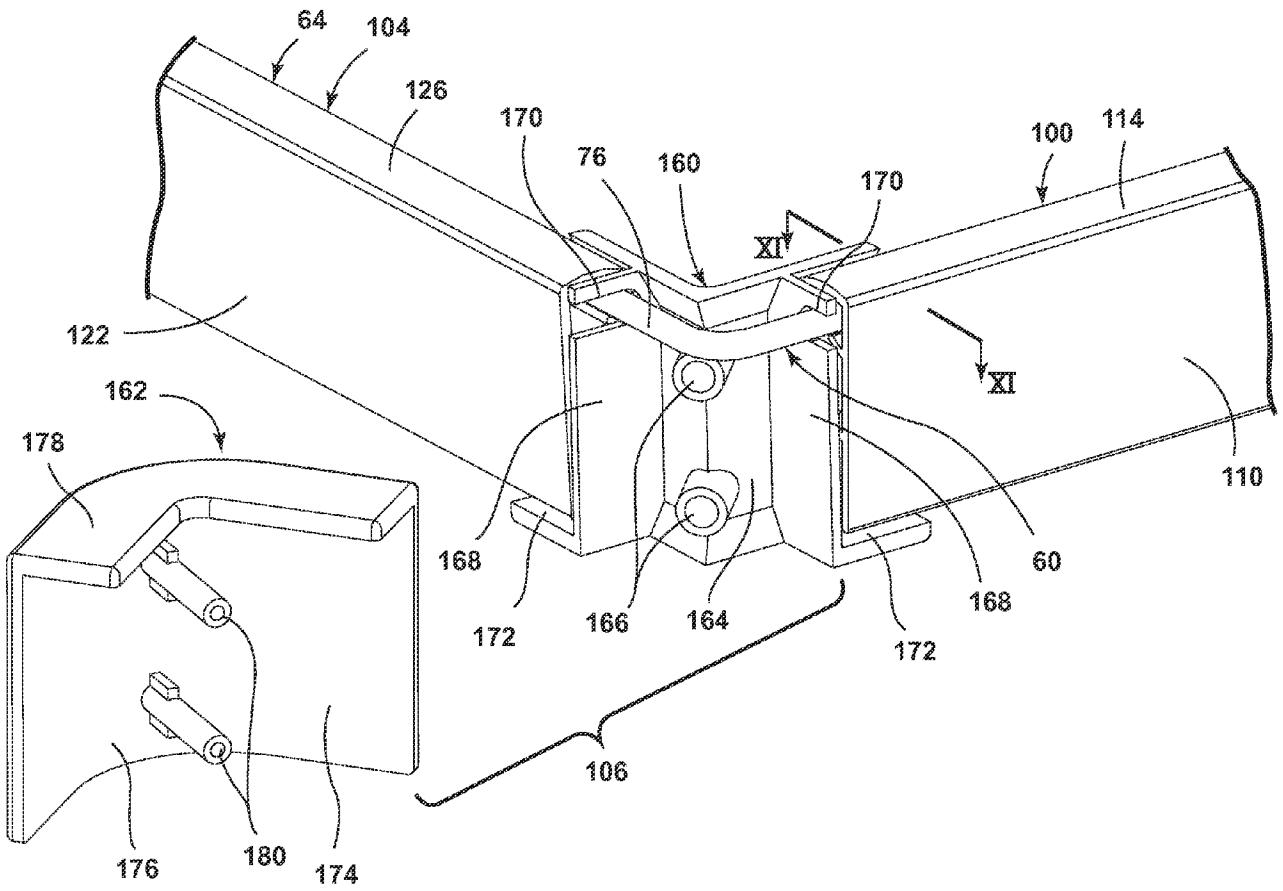
FIG. 10 is a partial perspective view of a side rail, a rear rail, and a rear tolerance adjuster of the upper trim assembly of FIG. 4B with an outer body of the rear tolerance adjuster shown as exploded.

Referring now to FIG. 10, the rear tolerance adjusters 106 that couple the side rails 100 to the rear rail 104 may be formed by an inner body 160 and an outer body 162 coupled to each other with at least one of the peripheral wire elements 76 and the mating ends of the rear rail 104 and the adjacent side rail 100 therebetween. The inner body 160 may include a generally L-shaped wall 164 contoured according to the rail inner walls 112, 124 and having a pair of outwardly extending bosses 166 positioned at the apex of the wall 164. In addition, a vertical flange 168 extends outwardly from each side of the L-shaped wall 164 and includes a slot 170 sized to accommodate the peripheral wire element 76. At each end of the inner body 160, a bottom wall 172 joins the lower edges of the L-shaped wall 164 and the vertical flange 168 between the vertical flange 168 and the end of the inner body 160 to create a space for receiving the end of the rear rail 104 or the adjacent side rail 100. The bottom wall 172 may include slots, openings, and the like if needed to accommodate any vertical portions of the side-to-side or the front-to-back wire elements 78, 80 (not shown). The outer body 162 may have a generally L-shaped wall 174 with an arcuate corner 176 and a top wall 178 extending generally perpendicular to and inward from the L-shaped wall 174. A pair of inwardly extending studs 180 sized for receipt within the bosses 166 for a heat staked coupling may be positioned on the corner 176 of the wall 174.

Figure 11:
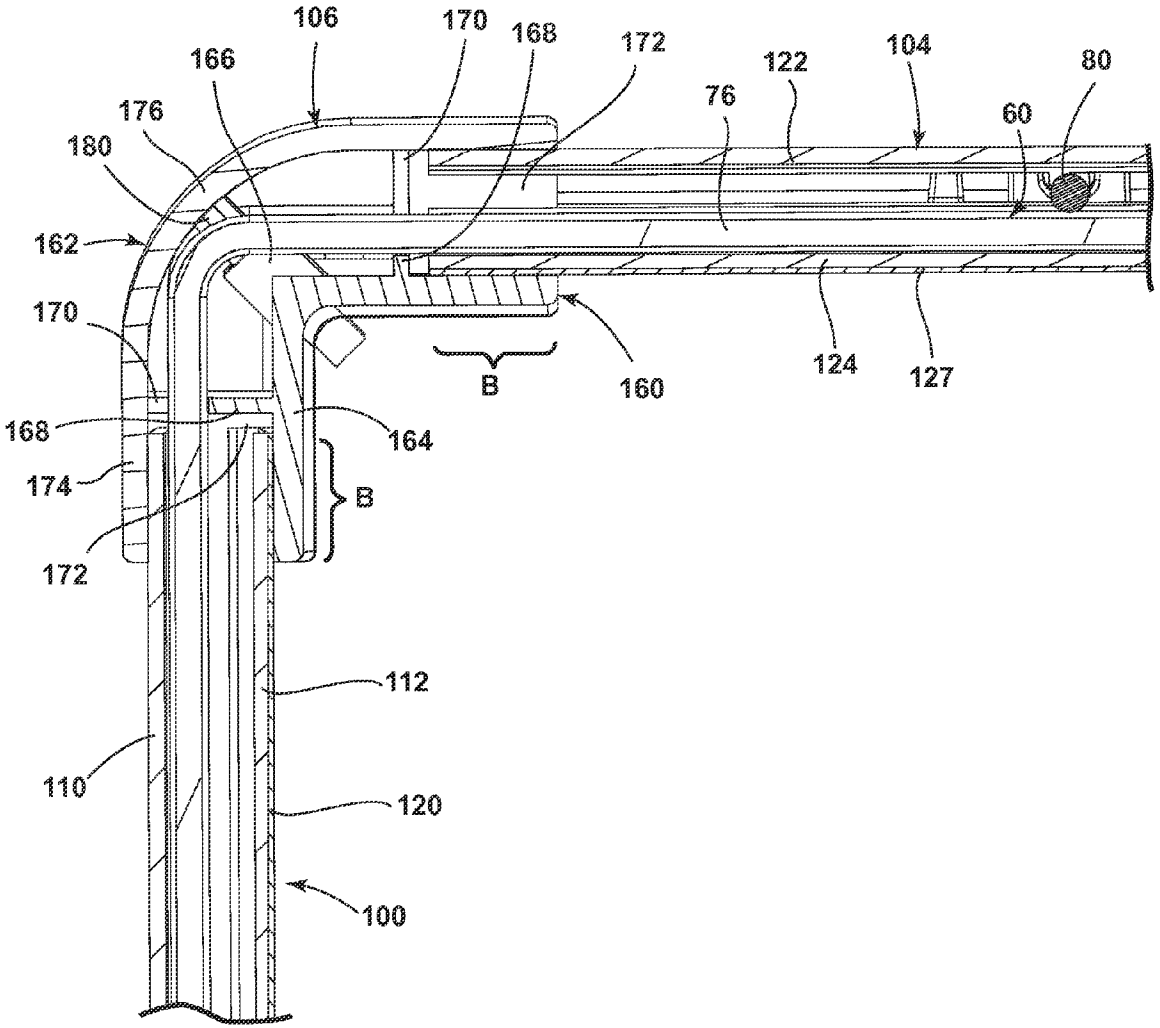
FIG. 11 is a sectional view taken along line XI-XI of FIG. 10.

As shown in the sectional view of FIG. 11, taken along line XI-XI of FIG. 10, the end of the rear rail 104 and the end of the adjacent side rail 100 overlap with the rear tolerance adjuster 106 at locations indicated as B. That is, the ends of the rails 104, 100 are received within opposite ends of the tolerance adjuster 106 and are visually hidden. In the illustrated embodiment, the ends of the rails 104, 100 may extend into the tolerance adjuster 106 a length as great as the distance between the end of the tolerance adjuster 106 and the vertical flange 168. The actual overlap length may vary and may depend on the variance of the perimeter length of the wire frame rack 60, as will be explained below in greater detail. An exemplary amount of overlap length is about 0.25 inch (6.35 mm).

Figure 12:
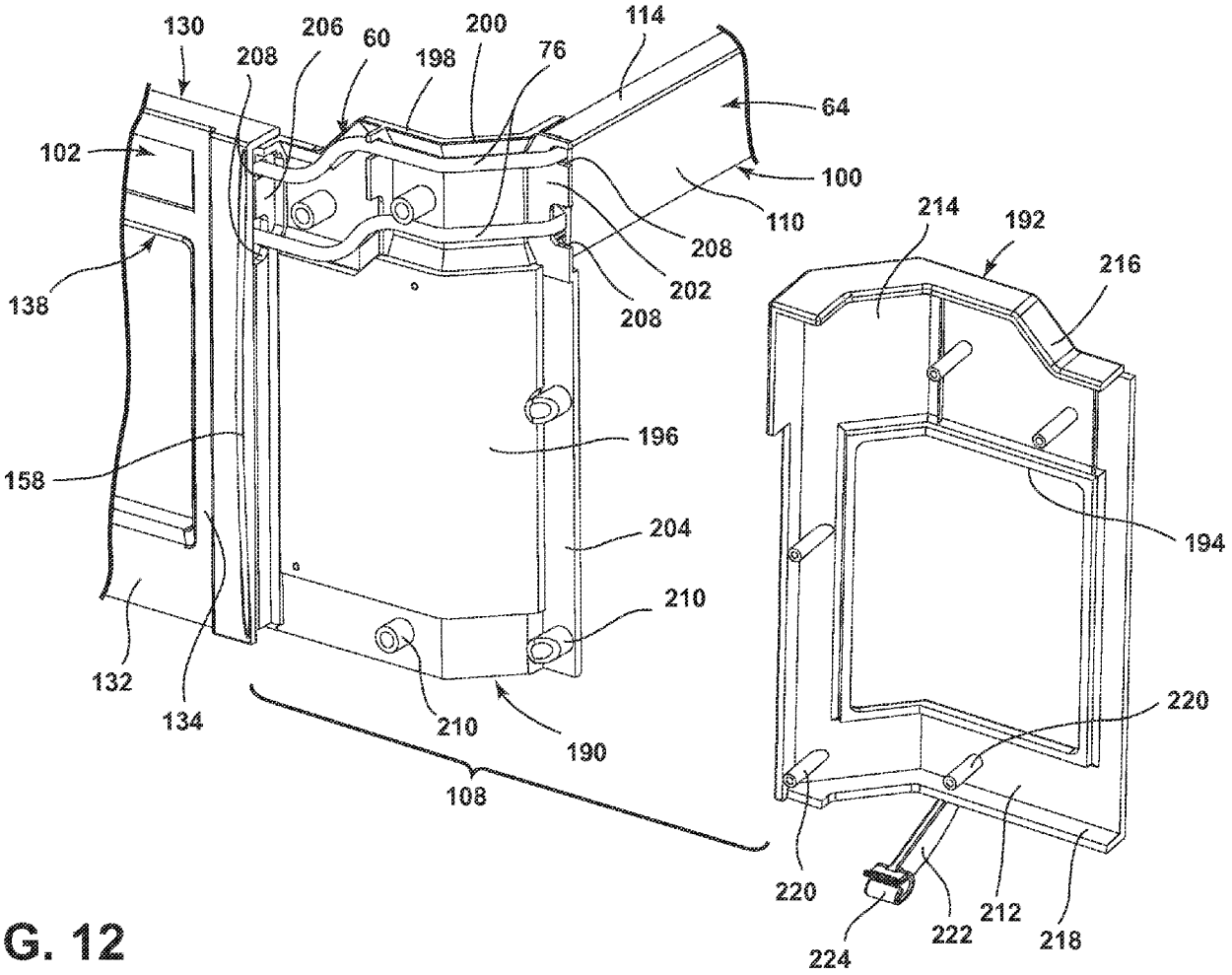
FIG. 12 is a partial perspective view of a side rail, a front frame, and a front tolerance adjuster of the upper trim assembly of FIG. 4B with an outer body of the front tolerance adjuster shown as exploded.

Referring now to FIG. 12, the front tolerance adjusters 108 that couple the side rails 100 to the front rail 102, particularly the front frame 130 in the illustrated embodiment, may be formed by an inner body 190 and an outer body 192 coupled to each other with at least one, and in this case two, of the peripheral wire elements 76 and the mating ends of the front frame 130 and the adjacent side rail 100 therebetween. The inner and outer bodies 190, 192 are generally configured to form a frame defining a central opening 194 that receives a panel 196, which may be any form of panel, including a translucent panel, for example. Other exemplary panels may include, but are not limited to, opaque, textured, perforated, and colored panels, or, alternatively, the panel 196 may be omitted. The inner body 190 may include a generally L-shaped wall 198 with an angled corner section 200, and an upper portion of the wall 198 may be contoured in accordance with the configuration of the peripheral wire elements 76. A vertical flange 202 extending outwardly from the wall 198 at one end of the front tolerance adjuster 108 transitions downwardly into a side wall 204. Another side wall 206 extends outwardly from the wall 198 at the other end of the front tolerance adjuster 108. The side walls 204, 206 may include slots 208 to accommodate the peripheral wire elements 76. Additionally, the inner body 190 may include several outwardly extending bosses 210 on, for example, the L-shaped wall 198 and the side wall 204. The outer body 192 may include a generally L-shaped wall 212 with an angled corner section 214 and may be contoured similar to the inner body L-shaped wall 198. Further, a top wall 216 and a bottom wall 218 may extend inwardly from the upper and lower ends, respectively of the L-shaped wall 212. A plurality of studs 220 sized for receipt within the bosses 210 for heat stake coupling may be located on an inside surface of the L-shaped wall 212. In addition, an arm 222 with a clip 224 may extend rearwardly from the wall 212 for coupling with one of the side-to-side wire elements 78 as described earlier for the front frame 130.

Figure 13:
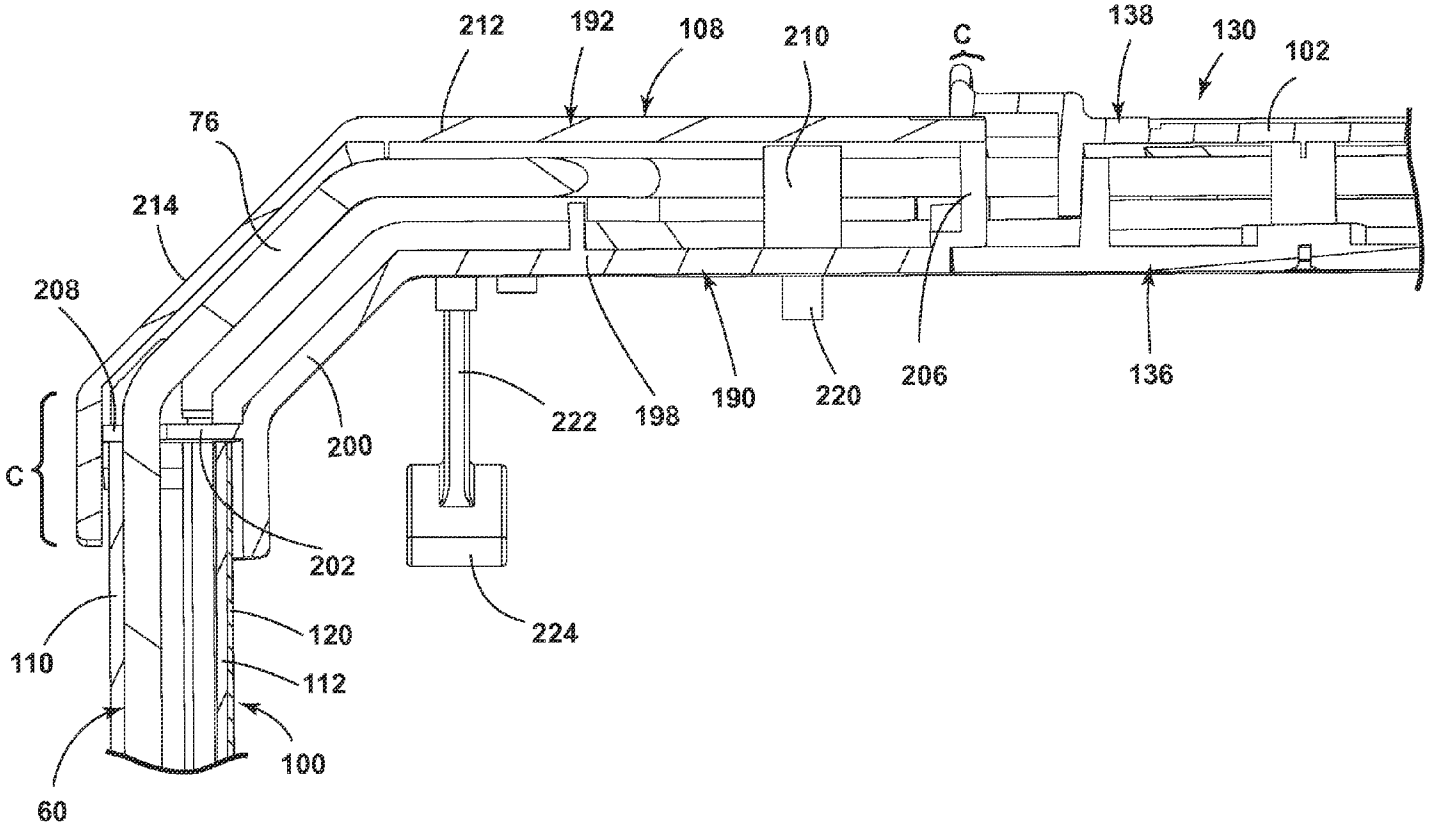
FIG. 13 is a sectional view taken along line XIII-XIII of FIG. 12.

As shown in the sectional view of FIG. 13, taken along line XIII-XIII of FIG. 12, the end of the front frame 130 and the end of the adjacent side rail 100 overlap with the front tolerance adjuster 108 at a location indicated as C. Particularly, the end of the side rail 100 is received within an end of the tolerance adjuster 106 and is visually hidden. In the illustrated embodiment, the end of the side rail 100 may extend into the front tolerance adjuster 108 a length as great as the distance between the end of the tolerance adjuster 108 and the vertical flange 202. The actual overlap length may vary and may depend on the variance of the perimeter length of the wire frame rack 60, as will be explained below in greater detail. An exemplary amount of overlap length is about 0.25 inch (6.35 mm). At the other end of the front tolerance adjuster 108, the front frame 130 receives the end of the front tolerance adjuster 108 for a slight overlap.

The front frame 130 and the rear and front tolerance adjusters 106, 108 may be made of any suitable materials and may be, for example, injected molded of a plastic material. Exemplary plastic materials include, but are not limited to, a polypropylene copolymer with a talc filler, such as the commercial MDK310 material, ABS, and acetal.

An exemplary description of the assembly of the trim assembly 64 follows. It is to be understood that the assembly steps may occur in any suitable order and are not intended to be limited to the order described herein. To assemble the upper trim assembly 64 to the upper wire frame rack 60, the side rails 100 and the rear rail 104 are slid onto the upper ends of the wire frame rack side walls 68 and rear wall 72, respectively, as shown in FIG. 4B, through the open bottom of the rails 100, 104 until the rails 100, 104 snap in place due to the structure shown in FIGS. 6 and 7. Next, referring to FIG. 10, the rear tolerance adjusters 106 are mounted to the rear corners of the wire frame rack 60 by placing the inner and outer bodies 160, 162 onto the ends of the rear rail 104 and the adjacent side rails 100 in an overlapping manner and inserting the studs 180 through the bosses 166 for heat staking. The front tolerance adjusters 108 are mounted in a similar fashion to the front corners of the wire frame rack 60, as seen in FIG. 12. The inner and outer bodies 190, 192, with the panel 196 therebetween, are mounted onto the ends the side rails 100 in an overlapping manner with the studs 220 inserted through the bosses 210 for heat staking. Additionally, the clip 224 is coupled to one of the side-to-side wire elements 78. Finally, referring to FIG. 9, the front frame 130 is mounted to the front wall 70 of the wire frame rack 60 by inserting the tabs 148 into the upper slits 140 and pivoting the inner and outer panels 136, 138 toward each other with the peripheral wire elements 76 in between until the tangs 152 snap into the lower slits 144. The apertures 142 will be aligned with the screw bosses 150 for receipt of mechanical fasteners, such as screws, and the clips 156 can be coupled to one of the side-to-side wire elements 78.

Referring again to FIG. 4A, the perimeter of the wire frame rack 60 is a length that is the sum of the lengths of the individual walls 68, 70, 72 forming the peripheral wall. During manufacturing of the wire frame rack 60, a significant amount of dimensional variance from one rack to another of the same type of rack can occur, as much as 0.12-0.20 inches (3-5 mm) from side to side. Thus, the lengths of the walls 68, 70, 72, 74 can vary significantly from one rack to another such that a unitary trim assembly would likely encounter problems when fitting the trim assembly onto the wire frame rack 60. As seen in FIG. 4B, the upper trim assembly 64 has been designed to accommodate this variation in length by inclusion of the tolerance adjusters 106, 108 and the overlapping of the tolerance adjusters 106, 108 with the trim elements in the form of the side, front, and rear rails 100, 102, 104. The ends of the rails 100, 102, 104 can shift within the tolerance adjusters 106, 108 at the overlapping joint (locations B and C in FIGS. 11 and 13), and, thus, the effective length of the trim assembly 64 can be adjusted according to the actual length of the perimeter of the wire frame rack 60. Such is the case when the trim assembly 64 borders the entire wire frame rack 60 or only a portion of the wire frame rack 60 as the dimensional variance in length occurs on the individual walls 68, 70, 72 that form the perimeter.

Figure 14:
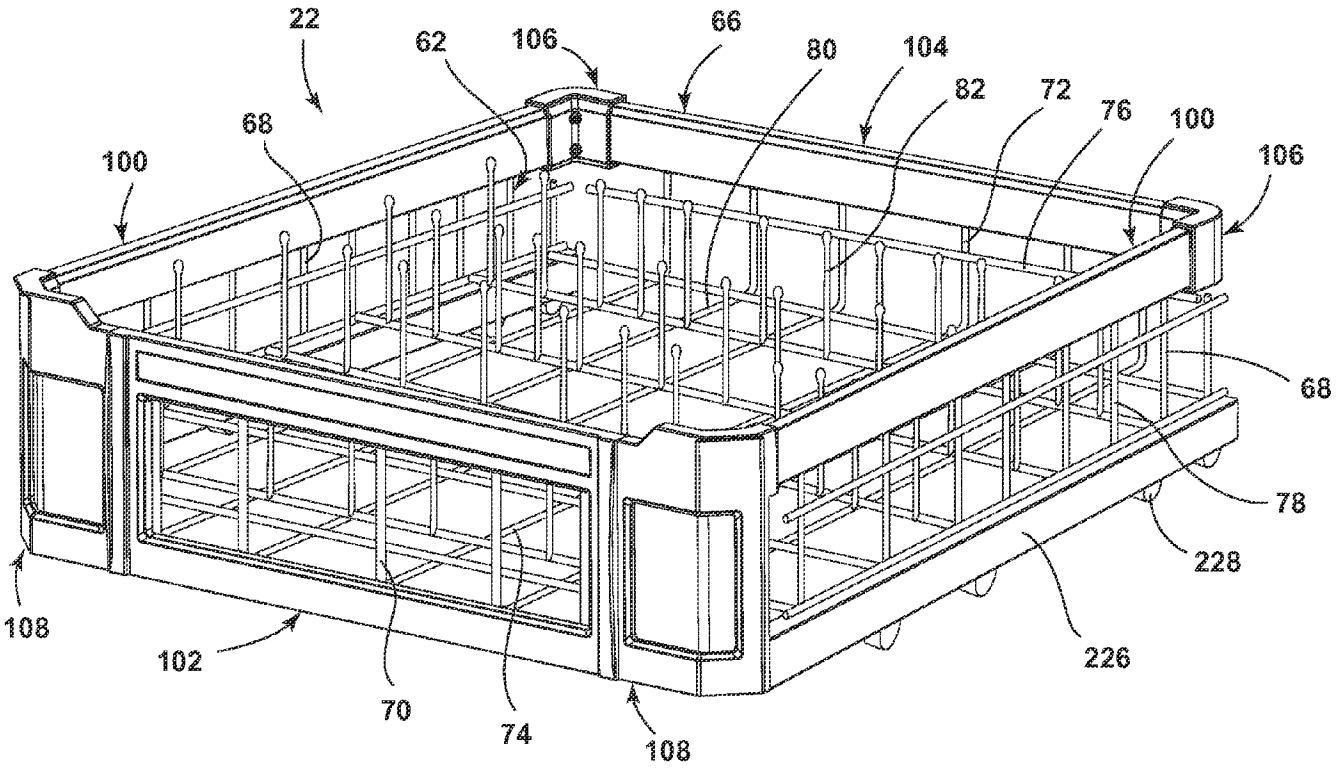
FIG. 14 is a perspective view of the lower dish rack assembly of FIG. 3 having a wire frame rack and a lower trim assembly.

Referring now to FIG. 14, the lower trim assembly 66 for the lower wire frame rack 62 may be similar to the upper trim assembly 64 for the upper wire frame rack 60, with modifications as necessary to accommodate structural differences between the wire frame racks 60, 62 and for stylistic differentiation, if desired. For example, the lower trim assembly 66 may include a lower side rail 226 generally parallel to the side rail 100 and located along a lower end of the side walls 68. At its forward end, the lower side rail 226 may cooperate with the front tolerance adjuster 108 in an overlapping manner to adjust the effective length of the trim assembly 64 and accommodate dimensional variation of the wire frame rack 62. The lower side rail 226 may be integrated with wheels 228 to facilitate rolling of the lower dish rack assembly 22 relative to the tub 14 and the door assembly 18 when the door assembly 18 is open (FIG. 3).

The above description and included figures relates to an exemplary embodiment of a dish rack assembly with a wire frame rack and trim assembly; it is contemplated that various aspects of the dish rack assembly may be modified. For example, the tolerance adjusters may be of a different type, may be mounted to the trim elements and/or the wire frame rack in an alternative manner, and may be positioned at different locations, such as between rails of the same type. The front tolerance adjuster, as an example, may have a configuration where it does not form a frame but has a linear configuration similar to the rear tolerance adjuster. Further, the trim assembly may employ other types and configurations of trim elements. For example, the front rail may be a simple rail, as with the side and rear rails, rather than as a part of the front frame. When a front frame is employed, it need not include the central opening but may rather be a solid panel. Alternatively, the side and/or rear rails may have a frame configuration. Various types of fasteners (e.g., screws), and coupling structures (e.g., heat staking studs, clips, tabs, tangs) have been described for mounting components and coupling components of the trim assembly; however, any suitable type of fastener, coupling structure, and coupling methods may be employed with the trim assembly. Further, other types of wire frame racks may be used with the trim assembly; the wire frame racks described herein are provided for exemplary purposes only.

Figure 15B:
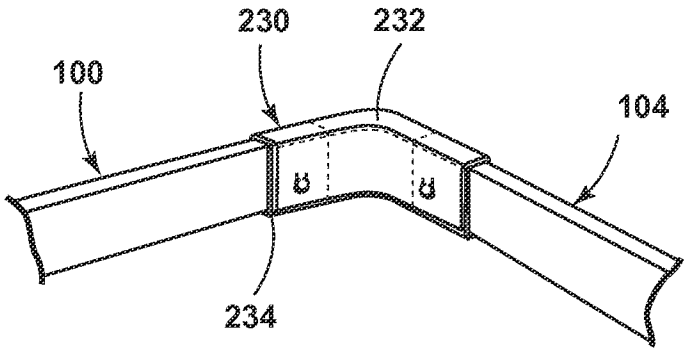
FIGS. 15A and 15B are exploded and assembled, respectively, schematic views of a tolerance adjuster according to another embodiment coupling adjacent rails of a trim assembly.
Figure 15A:
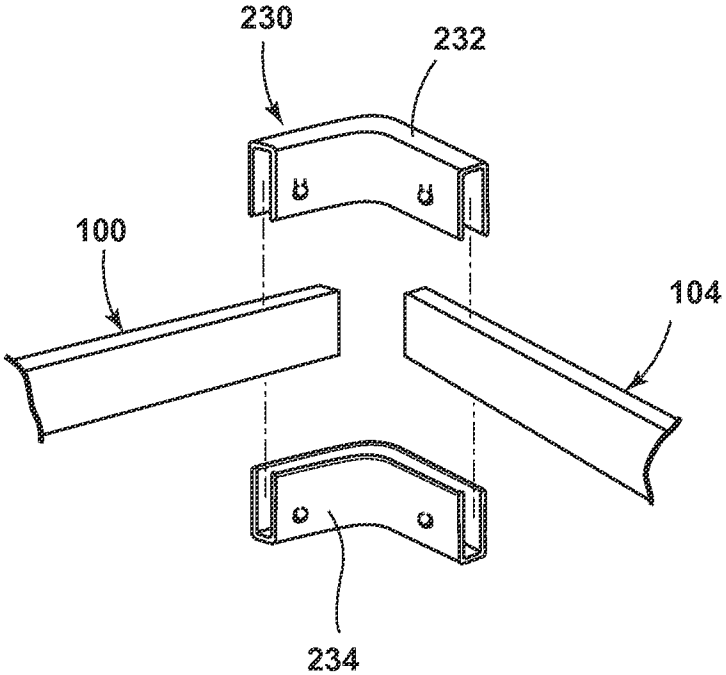

Exemplary alternative embodiments of the tolerance adjuster follow. FIGS. 15A (exploded) and 15B (assembled) schematically illustrate an alternative rear tolerance adjuster 230 having upper and lower bodies 232, 234 that mate with the adjacent ends of the side and rear rails 100, 104 therebetween. As with the previous embodiment, the rear tolerance adjuster 230 and the ends of the side and rear rails 100, 104 adjustably overlap to alter the effective length of the trim assembly and accommodate variation in the perimeter length of the wire frame rack (not shown). The upper body 232 may be placed onto the rails 100, 104 and the wire frame rack from above, while the lower body 234 may be placed onto the rails 100, 104 and the wire frame rack from below. The upper and lower bodies 232, 234 may couple in any suitable manner, such as by a snap-fit connection. The alternative rear tolerance adjuster 230 may be modified for use as a front tolerance adjuster or as an adjuster at another location on the trim assembly.

Figure 16B:
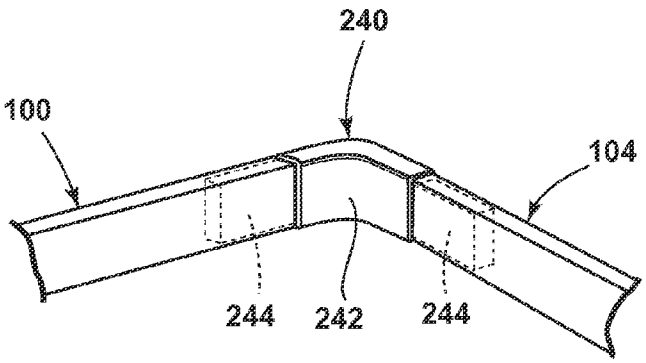
FIGS. 16A and 16B are exploded and assembled, respectively, schematic views of a tolerance adjuster according to another embodiment coupling adjacent rails of a trim assembly.
Figure 16A:
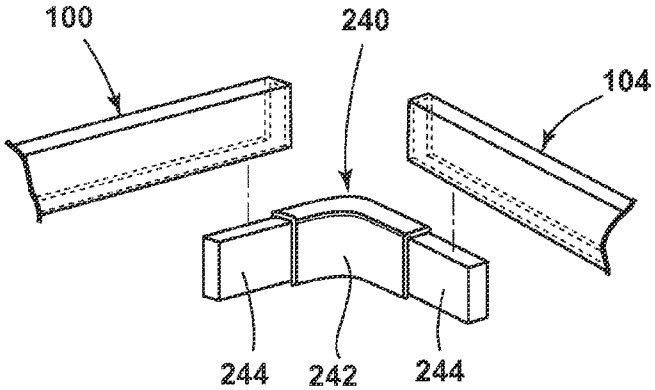
Figure 17:
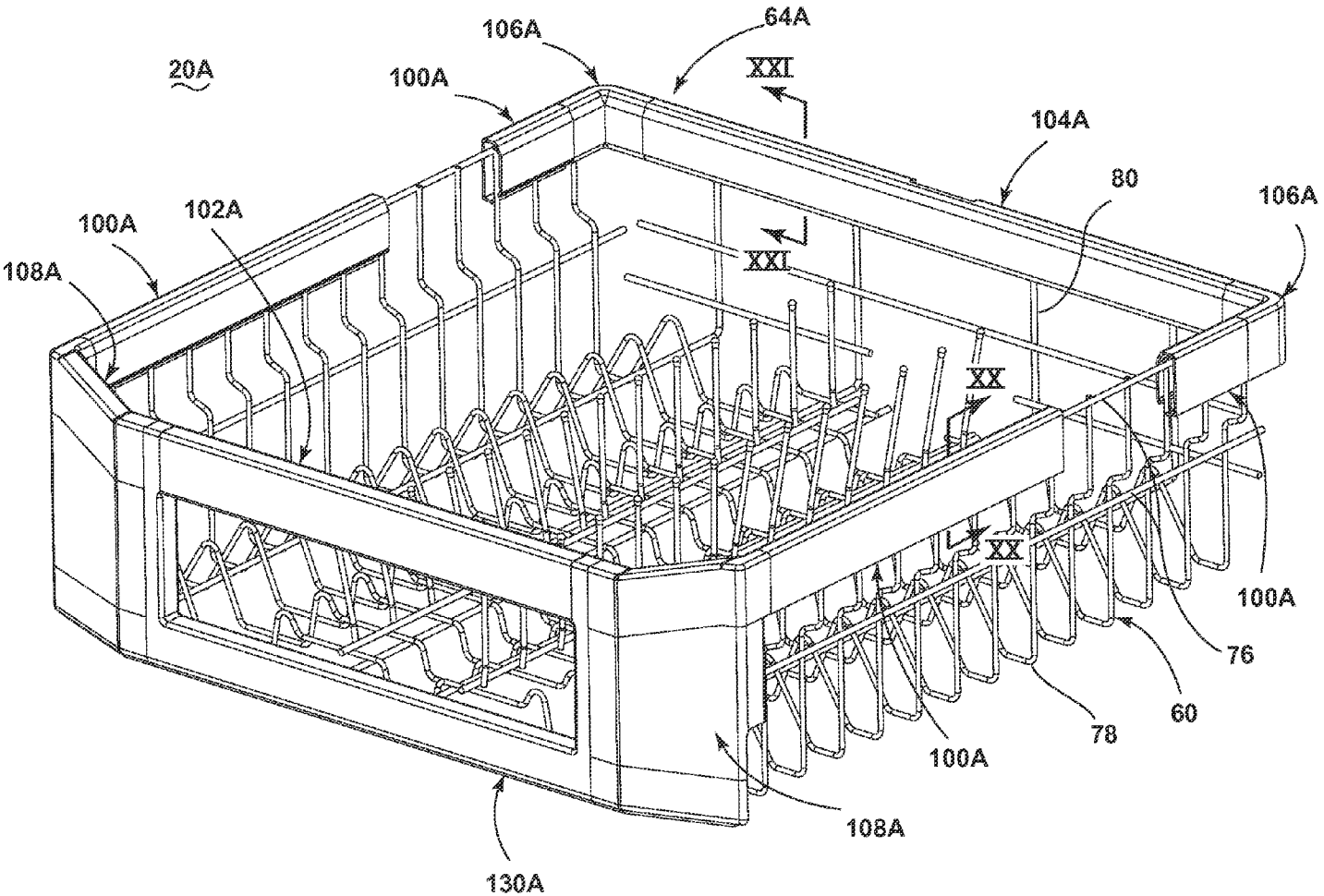
FIG. 17 is a perspective view of an upper dish rack assembly with a trim assembly according to another embodiment.

FIGS. 16A (exploded) and 16B (assembled) schematically illustrate an alternative rear tolerance adjuster 240 having a central body 242 with arms 244 extending outward from the central body 242 generally orthogonal to one another. The arms 244 may be slidingly received within the ends of the adjacent side and rear rails 100, 104 so that the arms 244 and the ends of the rails 100, 104 overlap in an adjustable manner so as to alter the effective length of the trim assembly and accommodate variation in the perimeter length of the wire frame rack (not shown). The rails 100, 104 may slide onto the arms 244 from above, as shown, or alternatively, from the sides of the arms 244 or in any other suitable manner. The arms 244 may be configured to form a friction fit with the rails 100, 104 and facilitate retaining the rails 100, 104 on the arms 244. Alternatively, the tolerance adjuster 240 may include a fastener system that couples the tolerance adjuster 240 to the rails 100, 104 in a desired position. Optionally, the rear tolerance adjuster 240 may omit a fastener system or features that actively couple the tolerance adjuster 240 to the rails 100, 104. The alternative rear tolerance adjuster 240 may be modified for use as a front tolerance adjuster or as an adjuster at another location on the trim assembly.

FIGS. 17-21 illustrate an alternative embodiment of an upper dish rack assembly 20A for the dishwasher 10. Elements similar to those in previous embodiments are identified with the same reference numeral bearing the letter "A." The trim assembly 64A is similar to the trim assembly 64 in that it includes the opposing side rails 100A joined to the rear rail 104A by the rear tolerance adjusters 106A and joined to the front rail 102A, formed by the front frame 130A, by the front tolerance adjusters 108A. The particular structure of these components differs in some aspects from those of the trim assembly 64, and the some of the differences are described below.

Figure 18A:
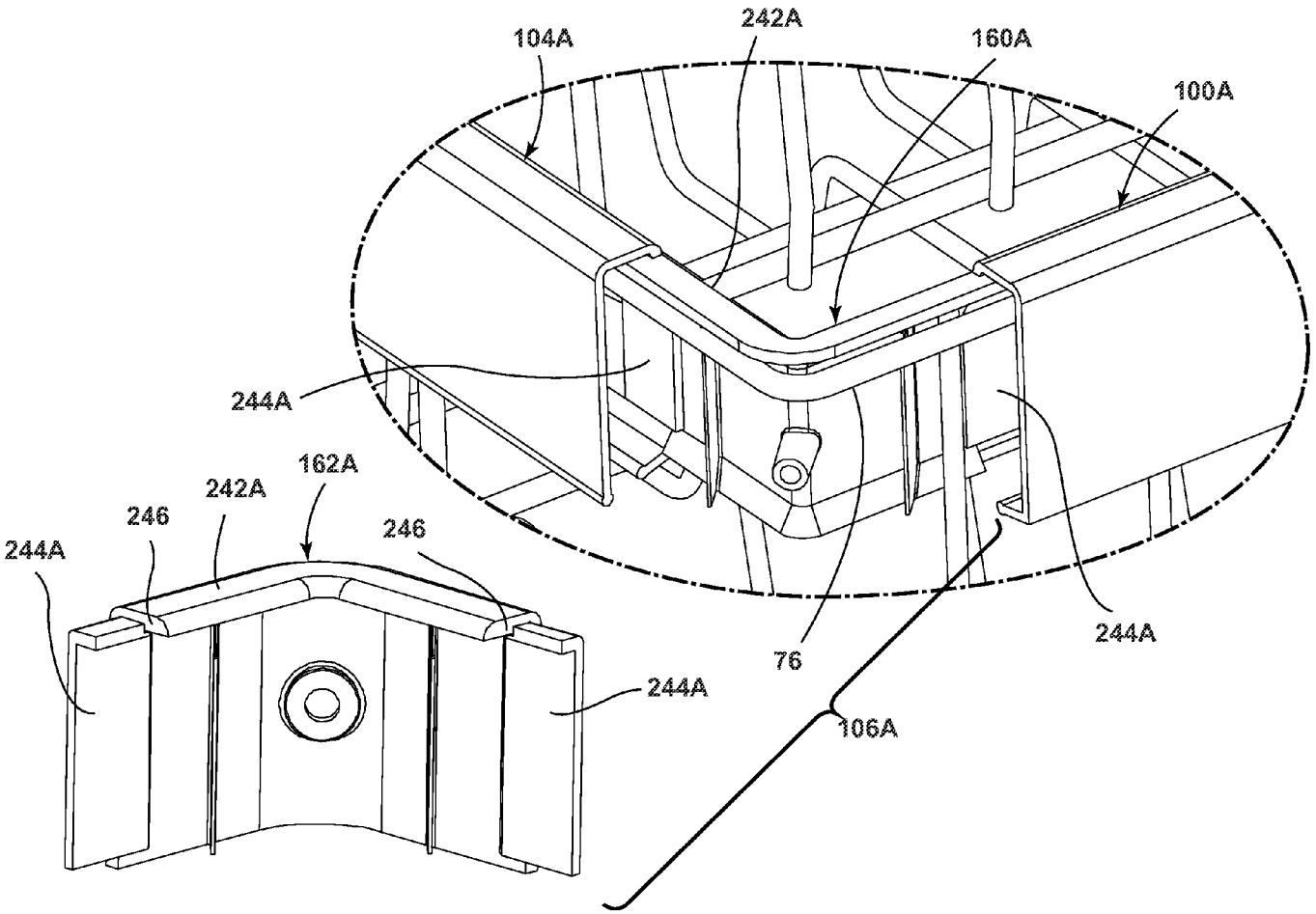
FIG. 18A is an enlarged rear perspective view of a rear tolerance adjuster and adjacent rails of the trim assembly of FIG. 17, with a portion of the rear tolerance adjuster shown as exploded.
Figure 18B:
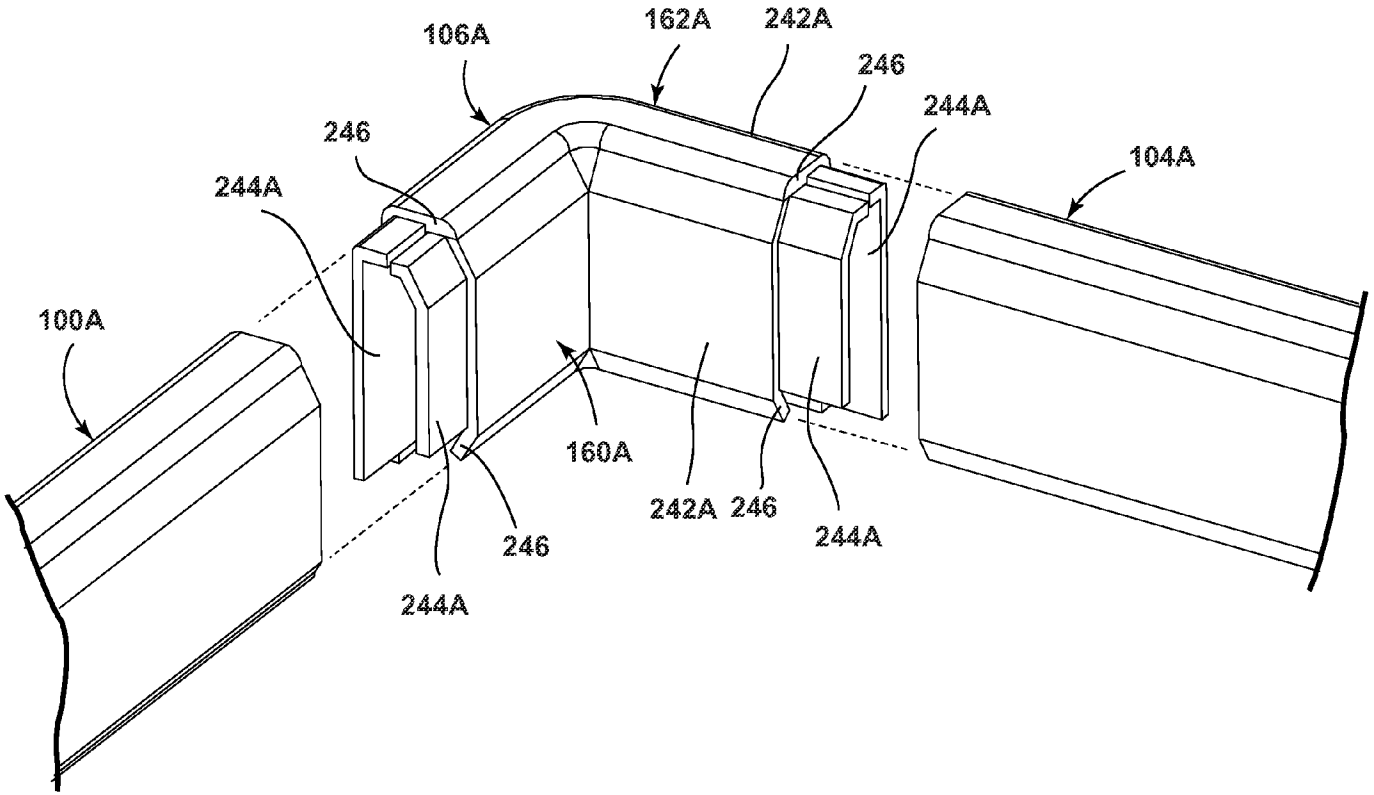
FIG. 18B is an exploded view of the rear tolerance adjuster and the adjacent rails of FIG. 18A.

Referring now to FIG. 18A, which is a view of the rear tolerance adjuster 106A and the adjacent side rail 100A and the rear rail 104A, the rear tolerance adjuster 106A may include an inner body 160A and an outer body 162A coupled together in any suitable manner with at least one of the peripheral wire elements 76 therebetween. Each of the inner and outer bodies 160A, 162A may have a generally L-shaped central body 242A that steps down at both lateral ends to an extension 244A, similar to the arms 244 of the embodiment in FIGS. 16A and 16B, thus forming a generally vertical face 246 between the central body 242A and each of the extensions 244A. The face 246 for the inner body 160A is best viewed in FIG. 18B, which is a view of the rear tolerance adjuster 106A exploded from the adjacent side rail 100A and the rear rail 104A. The extensions 244A on the inner and outer bodies 160A, 162A may be shaped for receipt within the ends of the adjacent side rail 100A and the rear rail 104A.

Figure 18C:
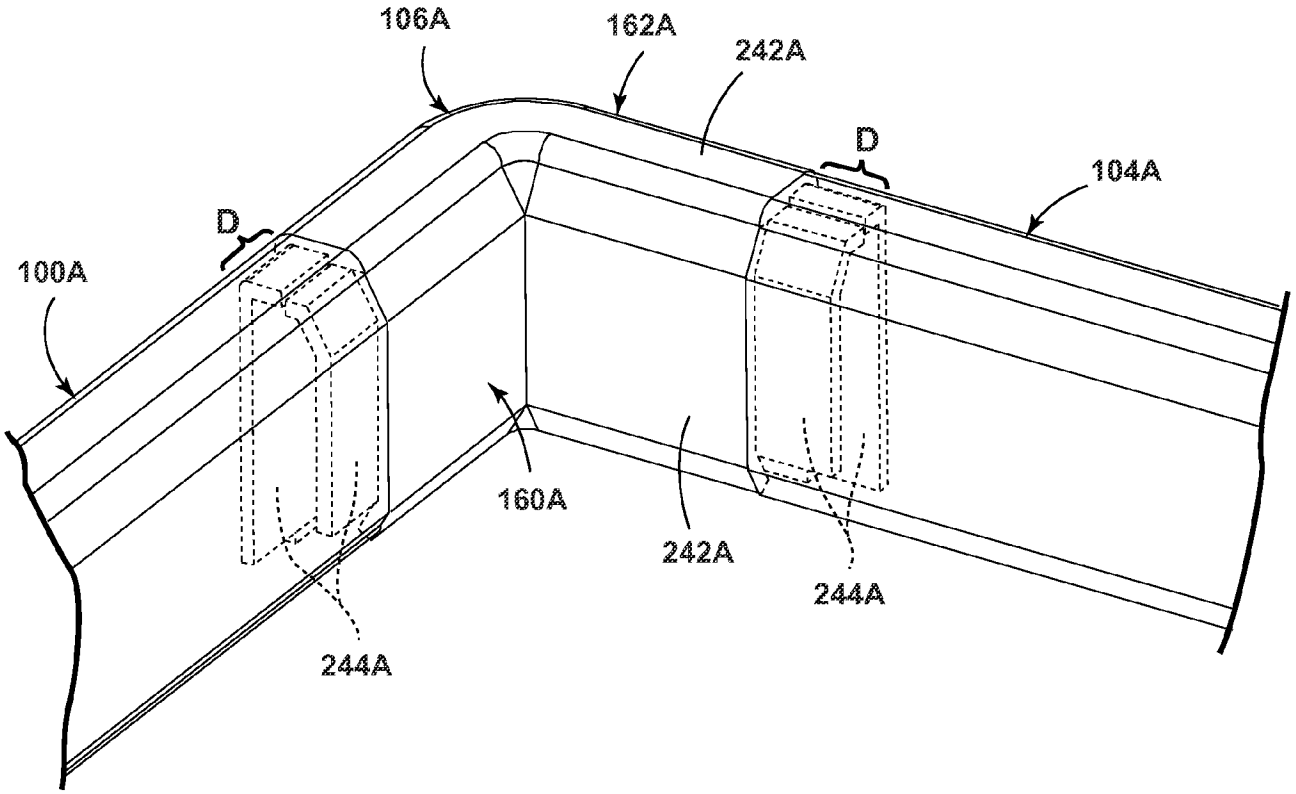
FIG. 18C is a front perspective view of the rear tolerance adjuster and the adjacent rails of FIG. 18A with the rails directly abutting faces of the tolerance adjuster.
Figure 18D:
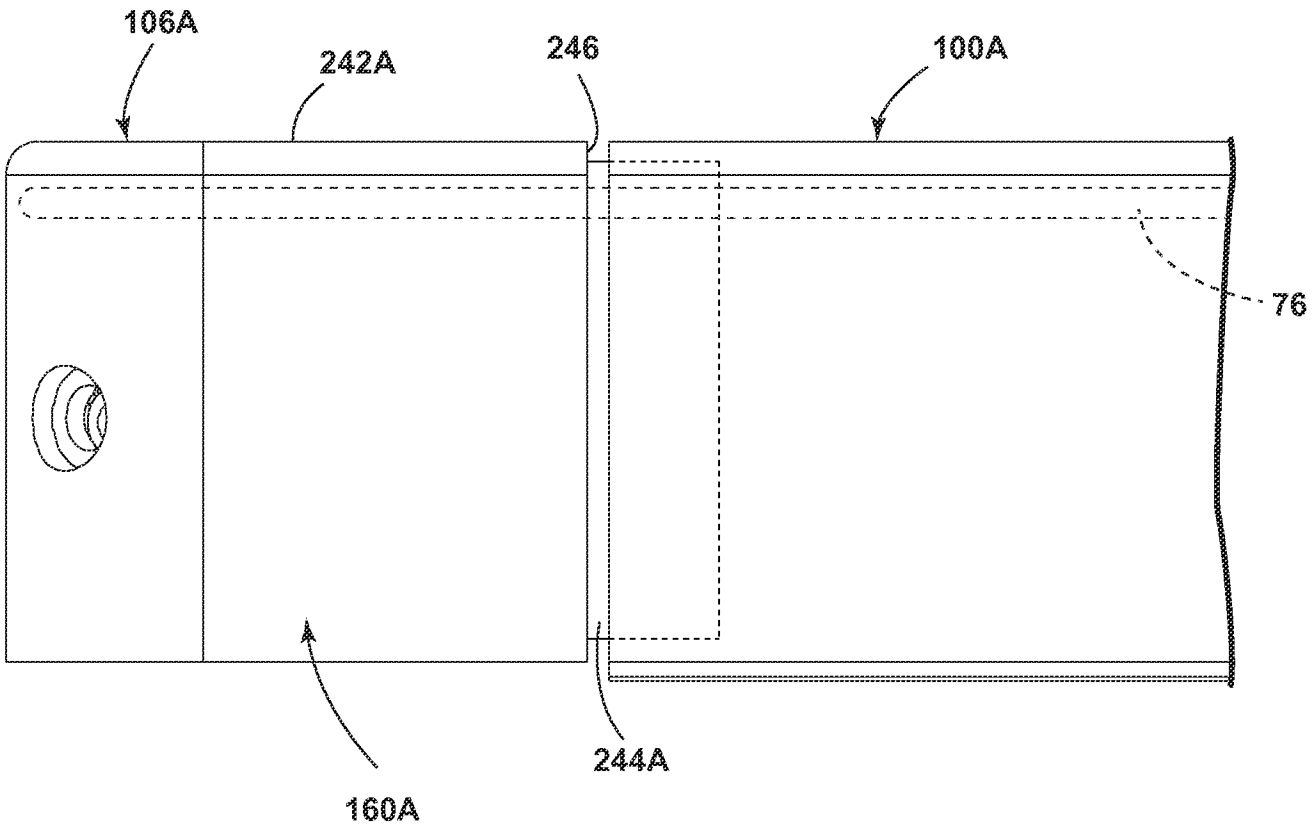
FIG. 18D is an enlarged view illustrating the rear tolerance adjuster and one of the rails of FIG. 18A with the rail spaced from the face of the tolerance adjuster.

When assembled as such, i.e., with the extensions 244A received within the ends of the adjacent side rail 100A and the rear rail 104A, these portions of the extensions 244A form an overlap D between the rear tolerance adjuster 106A and the adjacent side rail 100A and the rear rail 104A to accommodate dimensional variance in the wire frame rack 60, as shown in FIG. 18C. The relative positioning of the side rail 100A and the rear tolerance adjuster 106A and of the rear rail 104A and the rear tolerance adjuster 106A may be altered within the respective overlap D so as to alter the effective length of the trim assembly 64A and, thus, accommodate the rack dimensional variance. In one configuration, the ends of the adjacent side rail 100A and the rear rail 104A may abut the respective faces 246, as illustrated in FIG. 18C. In another configuration, illustrated in FIG. 18D for the side rail 100A, the ends of the adjacent side rail 100A and the rear rail 104A may be spaced from the respective faces 246 a distance less than the length of the extensions 244A, but the wire frame rack 60 will nonetheless be concealed from view because the portions of the respective extensions 244A between the spaced rail ends and faces 246 will cover the portion of the wire frame rack 60 located within the rear tolerance adjuster 106A.

Figure 19A:
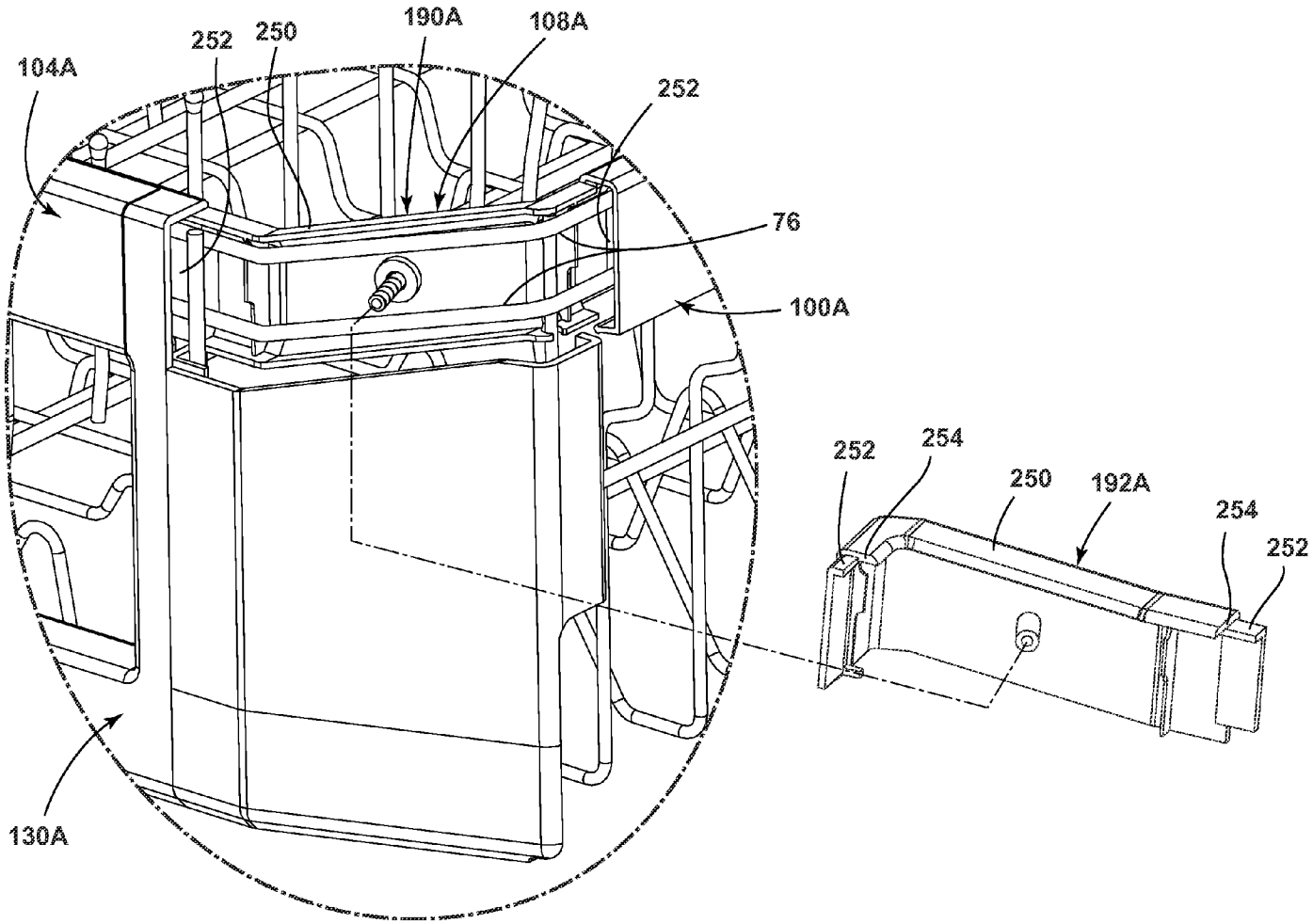
FIG. 19A is an enlarged rear perspective view of a front tolerance adjuster and adjacent rails of the trim assembly of FIG. 17, with a portion of the front tolerance adjuster shown as exploded.
Figure 19B:
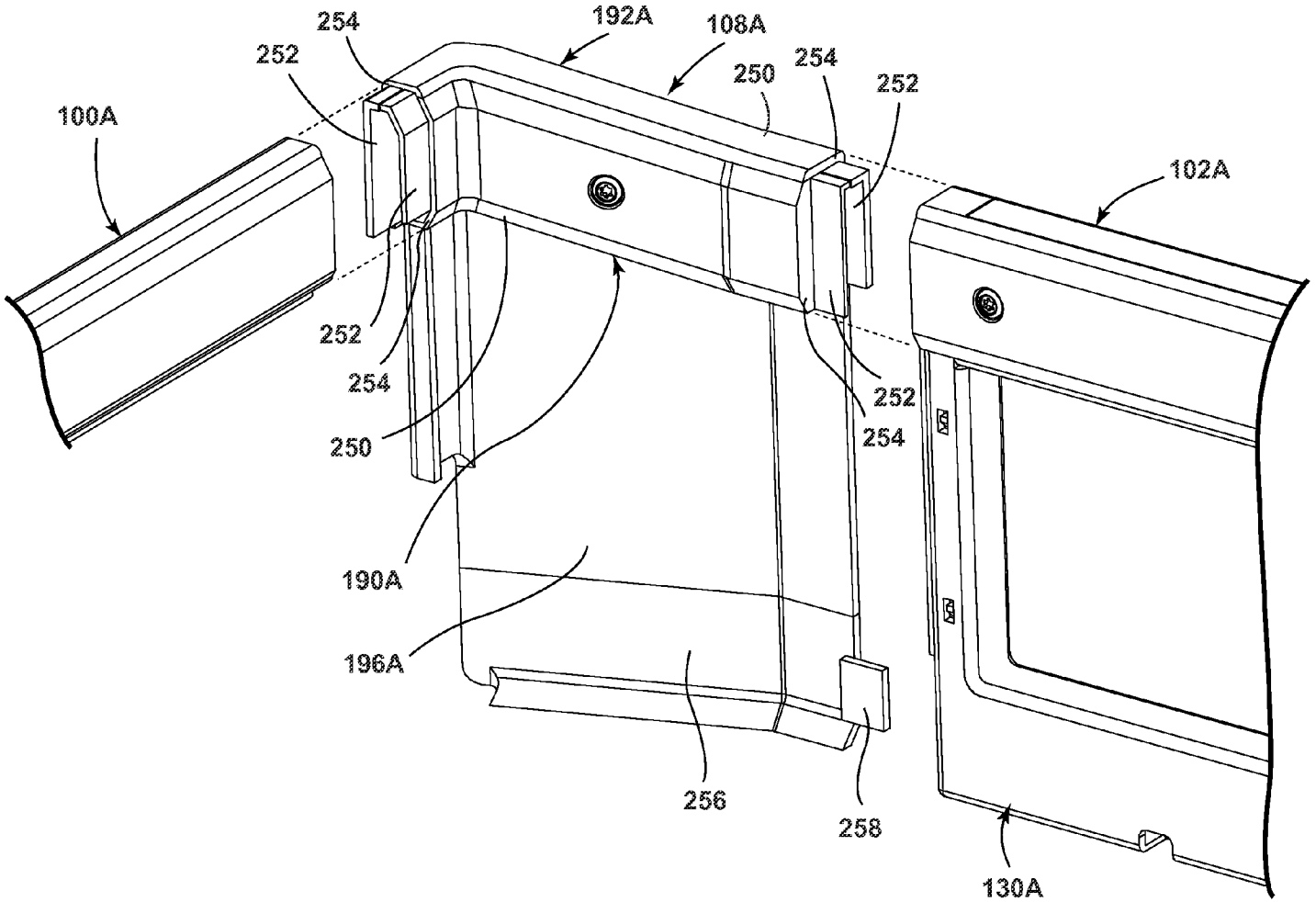
FIG. 19B is an exploded view of the front tolerance adjuster and the adjacent rails of FIG. 19A.

Referring now to FIG. 19A, which is a view of the front tolerance adjuster 108A and the adjacent side rail 100A and the front rail 102A formed by the front frame 130A, the front tolerance adjuster 108A may include an inner body 190A and an outer body 192A coupled to each other with at least one, and in this case two, of the peripheral wire elements 76 therebetween. While the inner and outer bodies 190, 192 the embodiment of FIG. 12 have a height corresponding to that of the wire frame 60 and are generally configured to form a frame, the inner and outer bodies 190A, 192A of the present embodiment of FIG. 19A are generally linear with a height corresponding to that of the adjacent side rail 102A. That is, the inner and outer bodies 190A, 192A cover only an upper portion of the wire frame rack 60. Each of the inner and outer body 190A, 192A may include an elongated central body 250 angled to accommodate the configuration of the wire frame rack 60. The central body 250 steps down at both lateral ends to an extension 252, thus forming a generally vertical face 254 between the central body 250 and each of the extensions 252. The face 254 for the inner body 190A is best viewed in FIG. 19B, which is a view of the front tolerance adjuster 108A exploded from the adjacent side rail 100A and the front rail 102A. The extensions 252 on the inner and outer bodies 190A, 192A may be shaped for receipt within the ends of the adjacent side rail 100A and the front rail 102A.

An optional corner panel 196A, which may be any form of panel as described earlier for the panel 196 and may have any suitable configuration, may be positioned between the rear tolerance adjuster 108A and a lower corner trim element 256. The lower corner trim element 256 may include an extension 258 shaped for receipt within the adjacent front frame 130A.

Figure 19C:
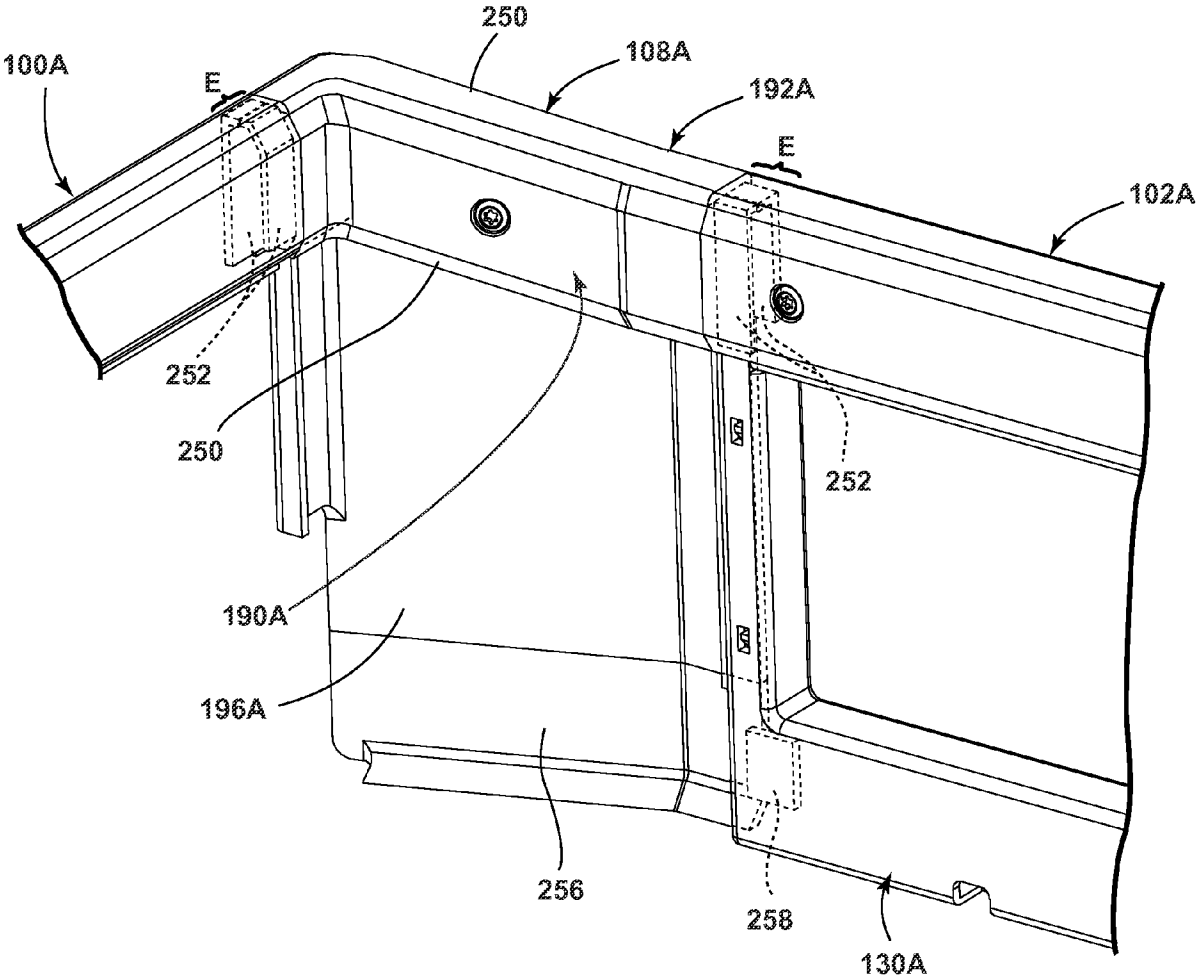
FIG. 19C is a rear perspective view of the front tolerance adjuster and the adjacent rails of FIG. 19A with the rails directly abutting faces of the tolerance adjuster.
Figure 19D:
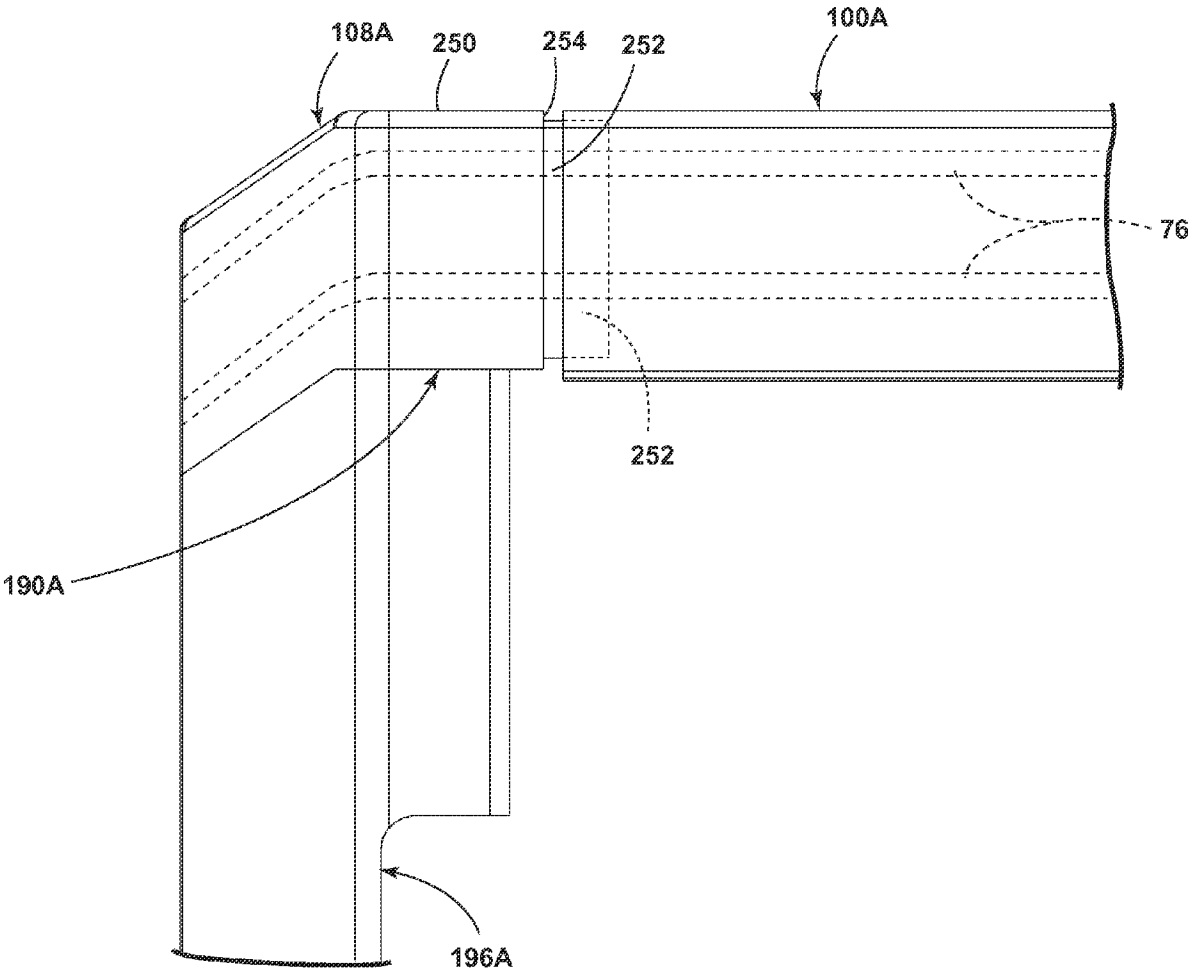
FIG. 19D is an enlarged view illustrating the front tolerance adjuster and one of the rails of FIG. 19A with the rail spaced from the face of the tolerance adjuster.

When assembled, as shown in FIG. 19C, the lower corner trim element 256 is received within the front frame 130, and the extensions 252 on the inner and outer bodies 190A, 192A are received within the ends of the adjacent side rail 100A and the front rail 102A. These portions of the extensions 252 in the adjacent side rail 100A and the front rail 102A form an overlap E between the front tolerance adjuster 108A and the adjacent side rail 100A and the front rail 102A to accommodate dimensional variance in the wire frame rack 60. The relative positioning of the side rail 100A and the front tolerance adjuster 108A and of the front rail 102A and the front tolerance adjuster 108A may be altered within the respective overlap E so as to alter the effective length of the trim assembly 64A and, thus, accommodate the rack dimensional variance. In one configuration, the ends of the adjacent side rail 100A and the front rail 102A may abut the respective faces 254, as illustrated in FIG. 19C. In another configuration, illustrated for the side rail 100A in FIG. 19D, the ends of the adjacent side rail 100A and the front rail 102A may be spaced from the respective faces 254 a distance less than the length of the extensions 252, but the wire frame rack 60 will nonetheless be concealed from view because the portions of the respective extensions 252 between the spaced rail ends and faces 254 will cover the portion of the wire frame rack 60 located within the front tolerance adjuster 108A.

Figure 21:
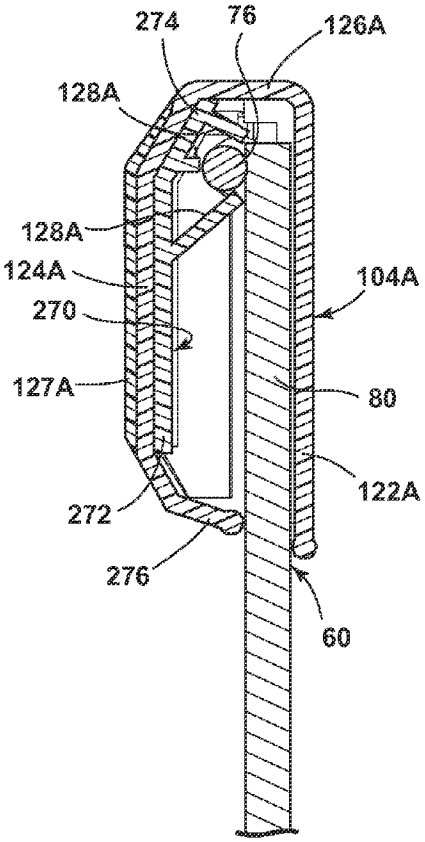
FIG. 21 is a sectional view taken along line XXI-XXI of FIG. 17.
Figure 20:
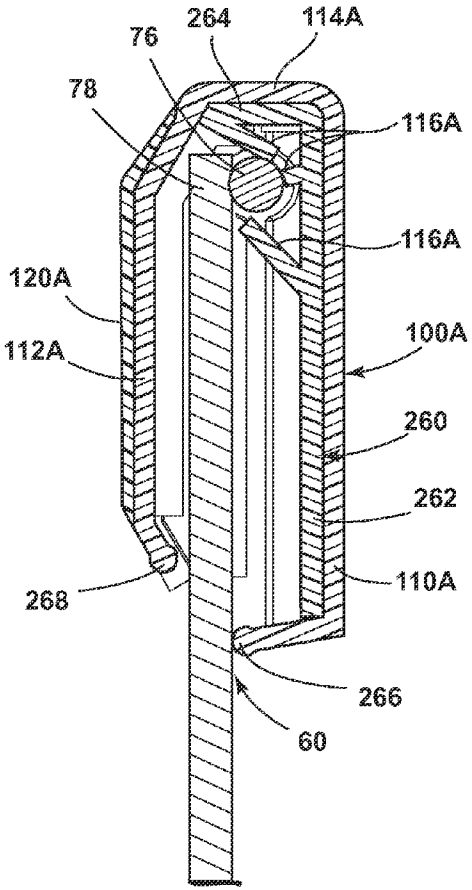
FIG. 20 is a sectional view taken along line XX-XX of FIG. 17.

FIGS. 20 and 21 illustrate, in sectional view, the configurations of the side rails 100A and the rear rail 104A. Referring to FIG. 20, the side rail 100A may include an insert 260 located within the side rail 100A. The exemplary insert 260 may have a generally L-shaped configuration with an upright portion 262 and an inwardly extending portion 264 oriented generally orthogonal to the upright portion 262 at the top of the upright portion 262. A plurality of projections 116A may extend from the insert 260 toward the peripheral wire element 76 of the wire frame rack 60. The illustrated embodiment has three of the projections 116A: a first extending downward from the end of the inwardly extending portion 264, and a second and a third extending from the upright portion 262. The particular lengths and angles of the projections 116A may be configured so as to engage the peripheral wire element 76 in a snap-fit manner. The outer portion of the side rail 100A that holds the insert 260 may include an outer wall 110A, an inner wall 112A, and a top wall 114A, similar to the side rail 100 of FIG. 5. In addition, the side rail 100A of FIG. 20 may further include angled outer and inner bottom walls 266, 268 depending from the lower ends of the outer and inner walls 110A, 112A, respectively, and projecting towards one another and the wire frame rack 60 held within the side rail 100A. The outer bottom wall 268 may be of sufficient length so as to abut the vertical portions of the side-to-side wire elements 76 and, thereby, help to orient the side rail 100A in a generally vertical position on the wire frame rack 60. The side rail 100A may also optionally include a soft-touch layer 120A on the inner wall 114A, as described the previous embodiment.

Referring now to FIG. 21, the rear rail 104A may include an insert 270 located within the rear rail 104A. The exemplary insert 270 may have an upright portion 272 and an outwardly extending portion 274 angled upward and outward relative to the upright portion 272 at the top of the upright portion 272. A plurality of projections 128A may extend from the insert 270 toward the peripheral wire element 76 of the wire frame rack 60. The illustrated embodiment has three of the projections 128A: a first and a second extending downward from the outwardly extending portion 274, and a third extending from the upright portion 272. The particular lengths and angles of the projections 128A may be configured so as to engage the peripheral wire element 76 in a snap-fit manner. The outer portion of the rear rail 104A that holds the insert 270 may include an outer wall 122A, an inner wall 124A, and a top wall 126A, similar to the rear rail 104 of FIG. 6. In addition, the rear rail 104A of FIG. 21 may further include an angled inner bottom walls 276 depending from the lower end of the inner wall 124A, projecting towards the outer wall 122A and the wire frame rack 60 held within the rear rail 104A. The inner bottom wall 276 may be of sufficient length so as to abut the vertical portions of the front-to-back wire elements 80 and, thereby, help to orient the rear rail 104A in a generally vertical position on the wire frame rack 60. The rear rail 104A may also optionally include a soft-touch layer 127A on the inner wall 124A, as described the previous embodiment.

The assembly of the trim assembly 64A of FIGS. 17-21 to the wire frame rack 60 is similar to the assembly described above for the wire frame rack 64 of the previous embodiment. The assembly method may be modified as needed to accommodate specific structures of the various components of the trim assembly 64A, and such modifications are apparent from the figures and the description provided above. Additionally, the trim assembly 64A may be adapted for use on the lower wire frame rack 62 for a lower dish rack assembly and may also be modified in any suitable manner; the exemplary modifications provided above the embodiment of FIGS. 3-13 apply to the present embodiment of FIGS. 17-21 and are not repeated for brevity.

While the invention has been specifically described in connection with certain specific embodiments thereof, it is to be understood that this is by way of illustration and not of limitation, and the scope of the appended claims should be construed as broadly as the prior art will permit.

What is claimed is:

1. A rack assembly for a dishwasher, the rack assembly comprising:

a wire frame rack having a plurality of wire elements forming a set of tines for supporting dishes in the dishwasher and a peripheral wall having an upper end, with at least a portion of the upper end having a first length; and a trim assembly having at least one trim element having a U-shaped cross-sectional configuration with an open bottom, and the upper end of the peripheral wall is slidingly received within the open bottom and at least one tolerance adjuster mounted to at least a portion of the peripheral wall upper end, with the at least one trim element and the at least one tolerance adjuster cooperating to alter an effective length of the trim assembly to correspond with the first length and thereby compensate for variation in the first length.

2. The rack assembly according to claim 1 wherein the at least one trim element comprises at least two rails mounted to the peripheral wall upper end, and the at least one tolerance adjuster couples the at least two rails to each other.

3. The rack assembly according to claim 2 wherein the at least one tolerance adjuster overlaps at least a portion of each of the at least two rails to accommodate the variation of the first length.

4. The rack assembly according to claim 3 wherein the at least one tolerance adjuster comprises first and second mating bodies, and the at least a portion of each of the at least two rails are received between the first and second mating bodies.

5. The rack assembly according to claim 2 wherein each of the at least two rails has a generally U-shaped cross-sectional configuration with an open bottom, and the upper end of the peripheral wall is slidingly received within the open bottom.

6. The rack assembly according to claim 5 wherein each of the at least two rails further comprises at least one interior projection that engages at least one of the plurality of wire elements to retain the rail on the peripheral wall.

7. The rack assembly according to claim 2 wherein at least one of the at least two rails comprises mating inner and outer rail portions, and the upper end of the peripheral wall is received between the inner and outer rail portions.

8. The rack assembly according to claim 1 wherein the trim assembly is mounted to the entire peripheral wall upper end such that the trim assembly borders the wire frame rack, and the first length corresponds to a perimeter of the wire frame rack.

9. The rack assembly according to claim 8 wherein the peripheral wall is formed by opposing side walls joined by a rear wall and a front wall, and the at least one trim element comprises a side rail mounted to the upper ends of each of the side walls, a rear rail mounted to the upper end of the rear wall, and a front rail mounted to the upper end of the front wall wherein the at least one tolerance adjuster comprises a first rear tolerance adjuster and a first front tolerance adjuster connecting one of the side rails to the rear rail and the front rail, respectively, and a second rear tolerance adjuster and a second front tolerance adjuster connecting the other of the side rails to the rear rail and the front rail, respectively.

10. The rack assembly according to claim 1 wherein the peripheral wall is formed by opposing side walls joined by a rear wall and a front wall, and the at least one trim element comprises a side rail mounted to the upper ends of each of the side walls and a front rail mounted to the upper end of the front wall, and the at least one tolerance adjuster comprises first and second front tolerance adjusters, each connecting the front rail to one of the side rails.

11. The rack assembly according to claim 10 wherein the front rail is part of a front frame comprising the front rail as a front upper rail and a front lower rail generally parallel to the front upper rail and connected to the upper front rail by a pair of spaced upright rails.

12. The rack assembly according to claim 11 wherein each of the first and second front tolerance adjusters forms a frame defining an opening receiving a panel.

13. The rack assembly according to claim 12 wherein the panel comprises a translucent window.

14. The rack assembly according to claim 11 wherein the front frame further comprises at least one clip extending from the front lower rail and coupling the front frame to at least one of the wire elements of the wire frame rack.

15. The rack assembly according to claim 10 wherein each of the first and second front tolerance adjusters comprises first and second mating bodies, and each of the first and second tolerance adjusters receives an end of one of the side rails between the first and second mating bodies in an overlapping configuration to accommodate the length variation of the wire frame rack.

16. The rack assembly according to claim 1 wherein the at least one trim element comprises at least one lower rail and the peripheral wall comprises a lower end, and wherein the at the at least one lower rail is mounted to the peripheral wall lower end, wherein the at least one lower rail comprises at least one wheel accommodating rolling movement of the rack assembly.

17. The rack assembly according to claim 1 wherein the at least one trim element and the at least one tolerance adjuster overlap to accommodate the variation of the first length.

18. The rack assembly according to claim 1 wherein the trim assembly further comprises at least one rail mounted to the peripheral wall, and the at least one rail has an inner wall with an inner surface comprising a first material and an outer wall comprising a second material different than the first material.

19. The rack assembly according to claim 18 wherein the first material is a soft-touch material.

20. The rack assembly according to claim 19 wherein the soft-touch material has a hardness not greater than about 55 Shore A.

* * * * *